US009334132B2

(12) United States Patent
Shikama et al.

(10) Patent No.: US 9,334,132 B2
(45) Date of Patent: May 10, 2016

(54) RECORDING APPARATUS

(71) Applicant: Brother Kogyo Kabushiki Kaisha, Nagoya-shi, Aichi-ken (JP)

(72) Inventors: Yasuhito Shikama, Nagoya (JP); Kohei Terada, Kiyosu (JP); Shinya Yamamoto, Nagoya (JP); Akihito Kobayashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/580,861

(22) Filed: Dec. 23, 2014

(65) Prior Publication Data

US 2015/0183602 A1 Jul. 2, 2015

(30) Foreign Application Priority Data

Dec. 27, 2013 (JP) ..... 2013-271990

(51) Int. Cl.

*B65H 5/22* (2006.01)
*B65H 5/26* (2006.01)
*B65H 7/02* (2006.01)
(Continued)

(52) U.S. Cl.

CPC . *B65H 5/26* (2013.01); *B41J 3/543* (2013.01); *B41J 13/0009* (2013.01); *B65H 5/062* (2013.01); *B65H 7/02* (2013.01); *B41J 11/0095* (2013.01); *B65H 29/60* (2013.01);
(Continued)

(58) Field of Classification Search

CPC ..... B65H 5/062; B65H 7/14; B65H 7/20; B65H 29/60; B65H 2301/448; B65H 2301/4482; B65H 2301/44822; B65H 2553/41; B41J 11/0095; B41J 13/009

See application file for complete search history.

(56) References Cited

U.S. PATENT DOCUMENTS 5,208,640 A 5/1993 Horie et al.
6,161,828 A 12/2000 Sussmeier
(Continued)

FOREIGN PATENT DOCUMENTS

JP 2002-103735 4/2002
JP 2002/302329 10/2002
(Continued)

OTHER PUBLICATIONS

U.S. Appl. No. 14/581,138.
(Continued)

*Primary Examiner* — Howard Sanders
(74) *Attorney, Agent, or Firm* — Frommer Lawrence & Haug LLP

(57) ABSTRACT

A recording apparatus includes: first and second recording modules; a storage accommodating a recording medium; a first path extending from the storage to the first recording module; a second path extending from the storage to the second recording module and including a first shared portion shared with the first path; a first roller pair disposed downstream of a branch position on the first path; and a second roller pair disposed on the first shared portion. The controller is configured to: determine whether a trailing edge of the recording medium on which recording is being performed by the first recording module is located downstream of the first roller pair on the first path; and when the trailing edge is located downstream of the first roller pair on the first path, cause the second roller pair to supply a recording medium from the storage to the second recording module.

12 Claims, 17 Drawing Sheets

(51) Int. Cl.

| | |
|---|---|
| ***B41J 13/00*** | (2006.01) |
| ***B41J 3/54*** | (2006.01) |
| ***B65H 5/06*** | (2006.01) |
| *B65H 29/60* | (2006.01) |
| *B41J 11/00* | (2006.01) |

(52) U.S. Cl.
CPC ..... *B65H 2301/44822* (2013.01); *B65H 2404/631* (2013.01); *B65H 2513/42* (2013.01); *B65H 2701/1313* (2013.01)

(56) References Cited

U.S. PATENT DOCUMENTS

| | | | | |
|---|---|---|---|---|
| 9,033,449 | B1 * | 5/2015 | Shikama ..... | B65H 5/06 347/16 |
| 2002/0024575 | A1 | 2/2002 | Sato | |
| 2002/0039116 | A1 | 4/2002 | Hashimoto | |
| 2002/0039131 | A1 | 4/2002 | Terauchi et al. | |
| 2002/0124748 | A1 | 9/2002 | Aida | |
| 2003/0063175 | A1 | 4/2003 | Nishikawa | |
| 2003/0161671 | A1 | 8/2003 | Hokiyama | |
| 2005/0100362 | A1 | 5/2005 | Kim et al. | |
| 2008/0208370 | A1 | 8/2008 | Bowers | |
| 2009/0141053 | A1 | 6/2009 | Dahlgren | |
| 2010/0315450 | A1 | 12/2010 | Fletcher et al. | |
| 2010/0315460 | A1 | 12/2010 | Matsuhashi | |
| 2011/0050778 | A1 | 3/2011 | Kaiho et al. | |
| 2012/0113204 | A1 | 5/2012 | Tanaka et al. | |
| 2013/0057630 | A1 | 3/2013 | Inoue et al. | |
| 2014/0292972 | A1 | 10/2014 | Terada | |
| 2014/0292973 | A1 | 10/2014 | Terada | |

FOREIGN PATENT DOCUMENTS

| | | |
|---|---|---|
| JP | 2005/199541 | 7/2005 |
| JP | 2012/240343 | 12/2012 |

OTHER PUBLICATIONS

U.S. Appl. No. 14/580,654.

* cited by examiner

RECORDING APPARATUS

CROSS REFERENCE TO RELATED APPLICATION

The present application claims priority from Japanese Patent Application No. 2013-271990, which was filed on Dec. 27, 2013, the disclosure of which is herein incorporated by reference in its entirety.

BACKGROUND

1. Technical Field

The present invention relates to a recording apparatus including a plurality of recording modules.

2. Description of the Related Art

There is known a recording apparatus including a plurality of recording modules. Each of the recording modules includes a head, a carriage, and an individual conveyor. For example, there is known a printer including two recording modules arranged vertically. This printer has a first conveyance path on which a first roller pair is disposed upstream of a first carriage, and a second roller pair is disposed downstream of a branch point and upstream of the first roller pair. A third roller pair is disposed on a shared conveyance path.

SUMMARY

It is possible to consider that the conventional printer is configured such that each recording module records an image on a sheet being conveyed intermittently. Here, in a case where the second and third roller pairs are driven independently of each other, individual motors are required for the respective second and third roller pairs, or in a case where a single roller is provided for the second and third roller pairs, a power-transmission switching mechanism is required, or control is complicated, leading to increased manufacturing cost.

The inventors of the present invention have examined an employment of a construction in which the second and third roller pairs are driven in synchronization with each other and have found the following problems. It is possible to consider that a sheet is supplied toward a second image forming device via the third roller pair in a state in which a trailing edge of the sheet on which image is being formed by a first image forming device is located upstream of the second roller pair on the conveyance path. In this case, it is possible to consider that the sheet on which image is being formed by the first image forming device is conveyed intermittently by the first roller pair. Since the second and third roller pairs are driven in synchronization with each other, if sheets are successively supplied by the roller pair to the second image forming device, the second roller pair is also driven with the third roller pair, which may cause a sheet jam between the second roller pair driven continuously and the first roller pair driven intermittently. A throughput may lower in a case where, to prevent such a jam, the sheet to be supplied to the second image forming device is intermittently conveyed by the third roller pair in accordance with the intermittent conveyance in the first image forming device.

This invention has been developed to provide a recording apparatus capable of improving a throughput while preventing a jam of a recording medium.

The present invention provides a recording apparatus including: a plurality of recording modules each including: a head formed with a plurality of ejection openings for ejecting liquid; a carriage supporting the head and configured to move the head in a first direction; a module path; and an individual conveyor configured to convey a recording medium along the module path in a second direction perpendicular to the first direction, the plurality of recording modules including a first recording module and a second recording module different from the first recording module; a storage configured to accommodate the recording medium; a first path through which the recording medium is to be conveyed from the storage to the module path of the first recording module; a second path through which the recording medium is to be conveyed from the storage to the module path of the second recording module, the second path including, at an upstream portion thereof, a first shared portion shared with the first path, the second path being branched off from the first path at a first branch position located at an end portion of the first shared portion; a first switcher configured to switch, at the first branch position, a destination of the recording medium between the first path and the second path; a first roller pair disposed downstream of the first branch position on the first path and including two rollers contacting each other, the first roller pair being configured to convey the recording medium in a state in which the recording medium is nipped by the two rollers of the first roller pair; a second roller pair disposed on the first shared portion and including two rollers contacting each other, the second roller pair being configured to convey the recording medium in a state in which the recording medium is nipped by the two rollers of the second roller pair; a driving device configured to drive the first roller pair and the second roller pair in synchronization with each other; a first sensor configured to output a signal indicating presence or absence of the recording medium at a first sensing position located on the first shared portion; and a controller configured to control the plurality of recording modules, the first switcher, and the driving device. The controller is configured to execute: a first determination processing in which based on the signal output from the first sensor the controller determines whether a trailing edge of the recording medium on which recording is being performed by the first recording module is located downstream of the first roller pair on the first path; and a first supply processing in which when the controller has determined in the first determination processing that the trailing edge of the recording medium is located downstream of the first roller pair on the first path, the controller controls the first switcher and the driving device to cause the second roller pair to supply a recording medium from the storage to the second recording module.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

Figure 1:
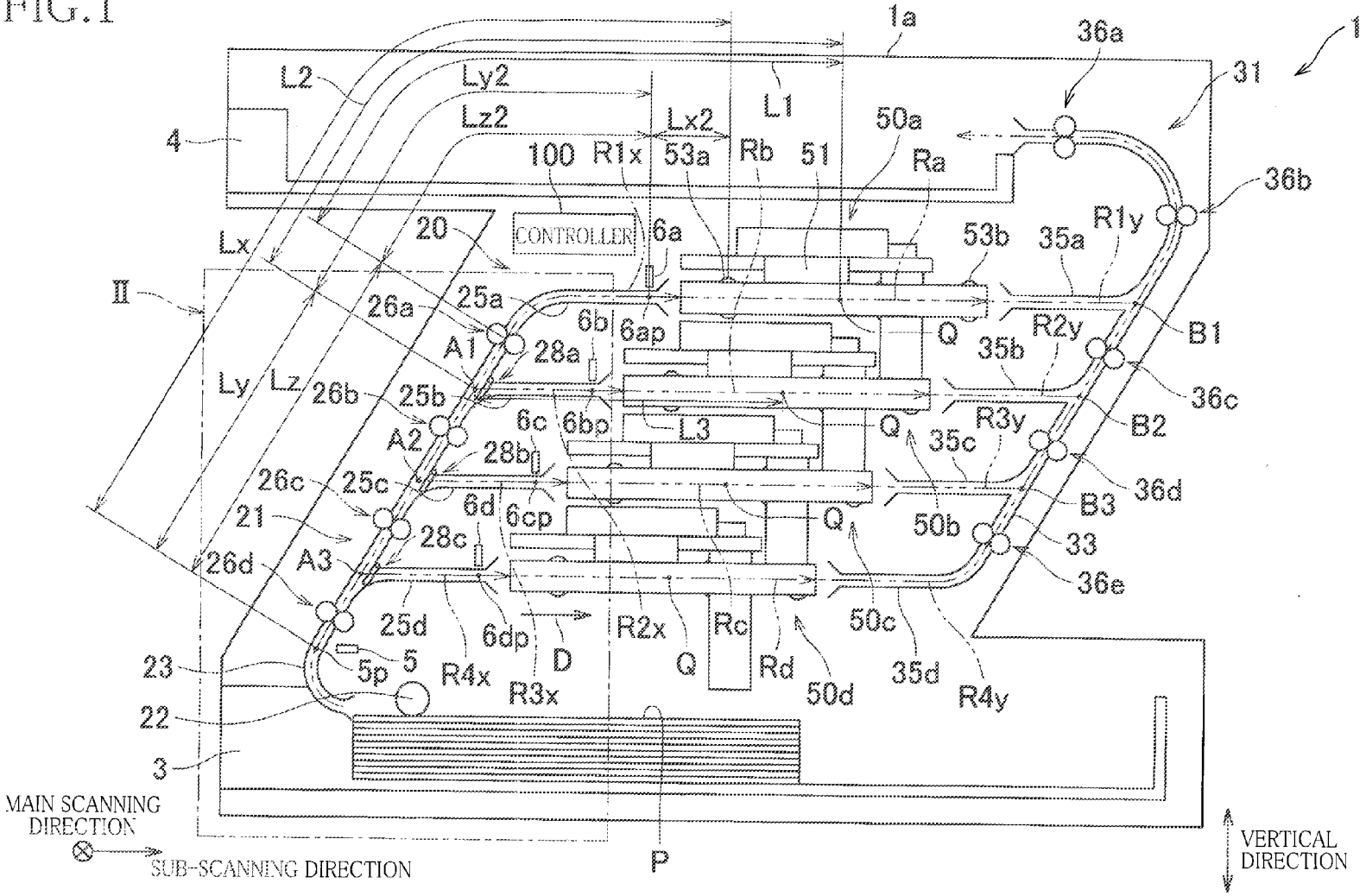
FIG. 1 is a schematic side view illustrating an internal structure of an ink-jet printer according to a first embodiment of the present invention.

Hereinafter, there will be described embodiments of the present invention by reference to the drawings.

First, there will be explained an overall configuration of an ink-jet printer 1 according to a first embodiment of the present invention with reference to FIG. 1.

The printer 1 includes a housing 1*a* having a Z-shape in cross section. Devices and components arranged in the housing 1*a* include recording modules 50*a*-50*d*, a conveying unit 20, a sheet storage 3, a sheet receiver 4, and a controller 100.

The recording modules 50*a*-50*d* are arranged in the vertical direction. A recording module 50*a* is the farthest from the sheet storage 3 and the nearest to the sheet receiver 4 among the recording modules 50*a*-50*d*. The recording module 50*d* is the nearest to the sheet storage 3 and the farthest from the sheet receiver 4 among the recording modules 50*a*-50*d*.

The recording modules 50*a*-50*d* have the same construction and each includes a head 51. Four cartridges, not shown, are mountable on and removable from the housing 1*a*. Each of the cartridges stores black ink and is connected to a corresponding one of the heads 51 by a tube and a pump. The controller 100 drives the pump to supply the ink from the cartridge to the head 51 through the tube.

The conveying unit 20 is configured to convey a sheet P as one example of a recording medium from the sheet storage 3 to the sheet receiver 4 via any one of the module paths Ra-Rd formed in the respective recording modules 50*a*-50*d*. The conveying unit 20 includes an upstream unit 21 and a downstream unit 31. The upstream unit 21 has paths R1*x*-R4*x* through which the sheet P is conveyed from the sheet storage 3 to the respective module paths Ra-Rd. The downstream unit 31 has paths R1*y*-R4*y* through which the sheet P is conveyed from the downstream end portions of the respective module paths Ra-Rd to the sheet receiver 4.

The paths R1*x*-R4*x* extend from the sheet storage 3 to the respective upstream end portions of the module paths Ra-Rd. The paths R1*x*, R2*x* extend from the sheet storage 3 to a branch position A1 by the same route and branch off at the branch position A1 so as to extend to the module paths Ra, Rb, respectively. The paths R2*x*, R3*x* extend from the sheet storage 3 to a branch position A2 by the same route and branch off at the branch position A2 so as to extend to the module paths Rb, Rc, respectively. The paths R3*x*, R4*x* extend from the sheet storage 3 to a branch position A3 by the same route and branch off at the branch position A3 so as to extend to the module paths Rc, Rd, respectively. The branch position A1 is a position of a boundary between a shared portion of the paths R1*x*, R2*x* and a non-shared portion of the paths R1*x*, R2*x*. The branch position A2 is a position of a boundary between a shared portion of the paths R2*x*, R3*x* and a non-shared portion of the paths R2*x*, R3*x*. The branch position A3 is a position of a boundary between a shared portion of the paths R3*x*, R4*x* and a non-shared portion of the paths R3*x*, R4*x*.

The upstream unit 21 includes a sheet-supply roller 22, roller pairs 26*a*-26*d*, guides 23, 25*a*-25*d*, and switchers 28*a*-28*c*.

The sheet-supply roller 22 is disposed so as to contact an uppermost one of the sheets P stored in the sheet storage 3. The controller 100 drives a sheet-supply motor 22M (see FIG. 6) to rotate the sheet-supply roller 22. This rotation supplies the uppermost sheet P from the sheet storage 3.

Each of the roller pairs 26*a*-26*d* has two rollers contacting each other and conveys the sheet P, with the two rollers nipping the sheet P therebetween. One of the two rollers of each of the roller pairs 26*a*-26*d* is a drive roller which is rotated by an upstream conveying motor 26M (see FIG. 6) driven by the controller 100. The other of the two rollers of each of the roller pairs 26*a*-26*d* is a driven roller which is rotated, in a direction reverse to a direction of the rotation of the drive roller, by the rotation of the drive roller while contacting the drive roller. As a result, the sheet P supplied by the sheet-supply roller 22 from the sheet storage 3 is conveyed to any one of the module paths Ra-Rd. The roller pairs 26*a*-26*d* are driven in synchronization with each other by the upstream conveying motor 26M.

Each of the guides 23, 25*a*-25*d* defines a corresponding one or ones of the paths R1*x*-R4*x* and includes a pair of plates arranged spaced apart from each other. The guides 25*a*-25*d* extend in the horizontal direction and define the respective downstream portions of the paths R1*x*-R4*x*. The guide 23 extends obliquely with respect to the vertical direction and defines the upstream portions of the respective paths R1*x*-R4*x*. The guide 25*a* is connected to the other end portion of the guide 23 from the sheet storage 3, and the guides 25*b*-25*d* are connected to the guide 23 other than its end portions.

The switchers 28*a*-28*c* are respectively arranged at the branch positions A1-A3. The switcher 28*a* at the branch position A1 switches a destination of the sheet P between the path R1*x* and the path R2*x*. The switcher 28*b* at the branch position A2 switches a destination of the sheet P between one of the paths R1*x*, R2*x* and the path R3*x*. The switcher 28*c* at the branch position A3 switches a destination of the sheet P between one of the paths R1*x*-R3*x* and the path R4*x*.

Figure 2:
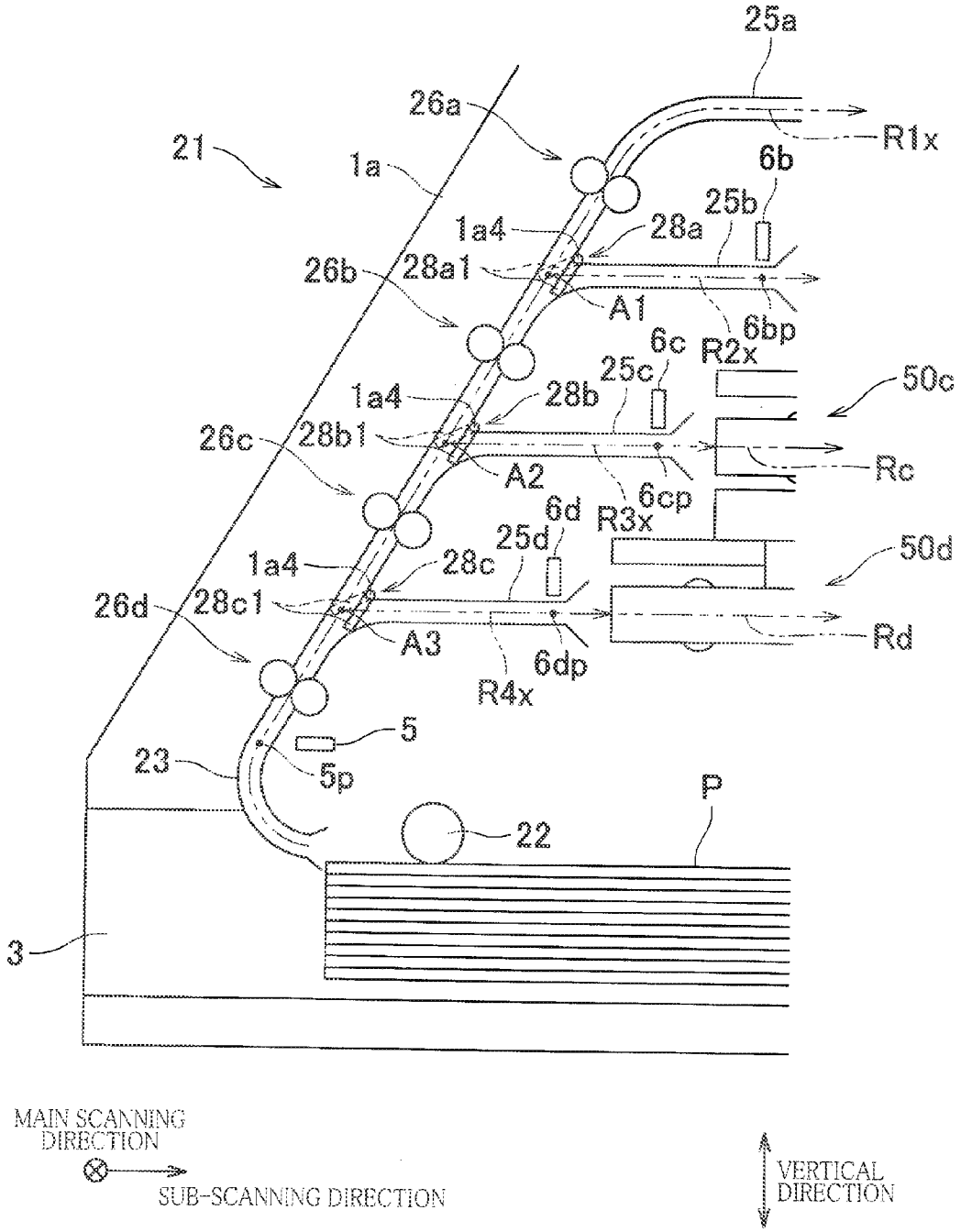
FIG. 2 is an enlarged view of the area II illustrated in FIG. 1.
Figure 6:
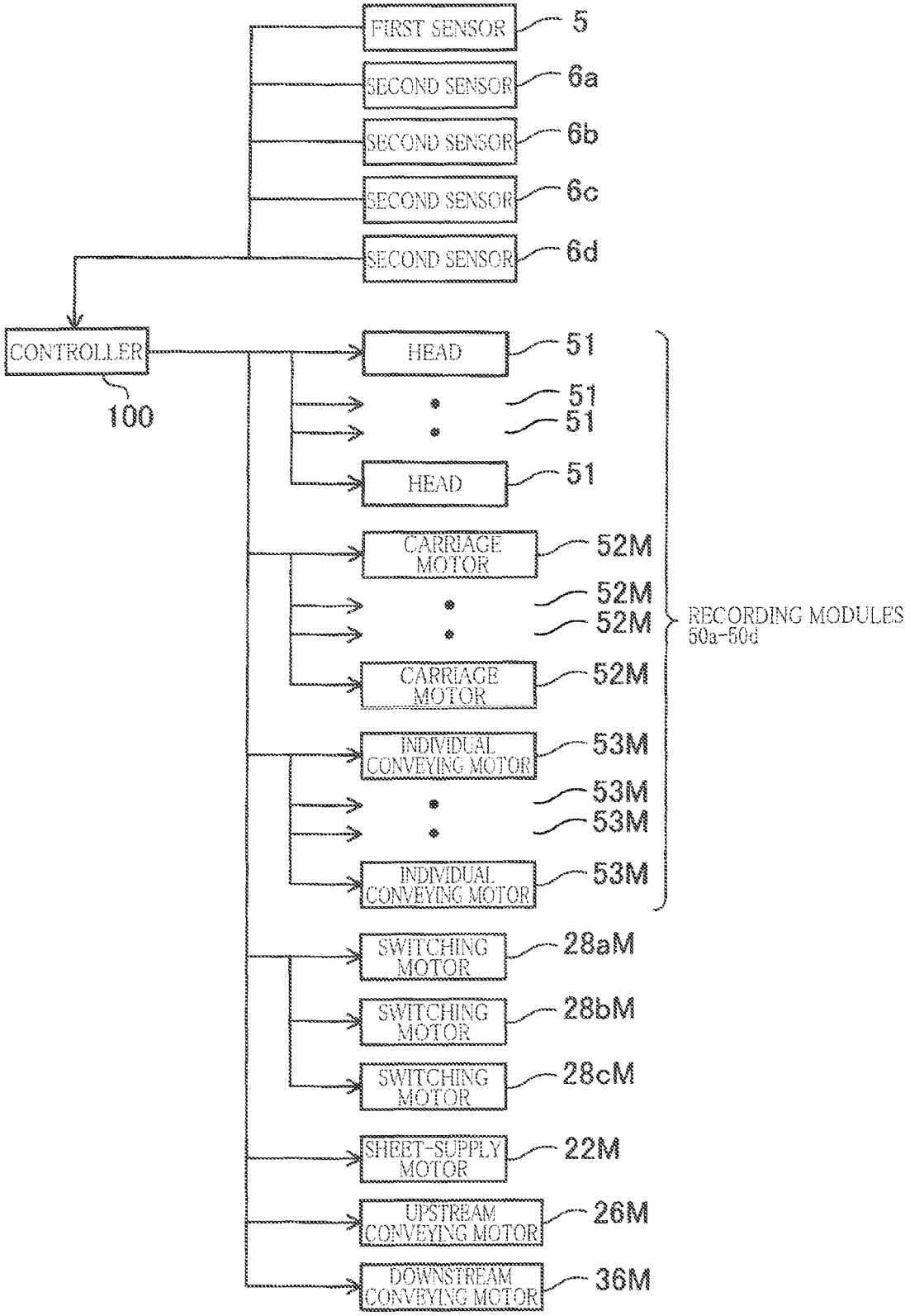
FIG. 6 is a block diagram illustrating an electric configuration of the printer illustrated in FIG. 1.

The switchers 28*a*-28*c* respectively include pivot members 28*a*1-28*c*1 (see FIG. 2) and switching motors 28*a*M-28*c*M (see FIG. 6). Each of the pivot members 28*a*1-28*c*1 is pivotable about a corresponding one of pins 1*a*4 provided in the housing 1*a*. The controller 100 drives each of the switching motors 28*a*M-28*c*M to switch a position of a corresponding one of the pivot members 28*a*1-28*c*1 between a first position indicated by solid lines in FIG. 2 and a second position indicated by broken lines in FIG. 2. At the first position, a distal end of each of the pivot members 28*a*1-28*c*1 is held in contact with the corresponding one of the guide 25*b*, 25*c*, 25*d*. At the second position, the distal end of each of the pivot members 28*a*1-28*c*1 is held in contact with the guide 23.

When the pivot member 28*a*1 is located at the first position, the path R1*x* is opened, and the path R2*x* is closed at the branch position A1. Accordingly, the sheet P having been conveyed from the sheet storage 3 to the branch portion A1 is conveyed to the module path Ra along the path R1*x*. When the pivot member 28*a*1 is located at the second position, the path R1*x* is closed, and the path R2*x* is opened at the branch position A1. Accordingly, the sheet P having been conveyed from the sheet storage 3 to the branch portion A1 is conveyed to the module path Rb along the path R2*x*.

When the pivot member 28*b*1 is located at the first position, the paths R1*x*, R2*x* are opened, and the path R3*x* is closed at the branch position A2. Accordingly, the sheet P having been conveyed from the sheet storage 3 to the branch portion A2 is conveyed to the branch position A1 along the shared portion of the paths R1*x*, R2*x*. When the pivot member 28*b*1 is located at the second position, the paths R1*x*, R2*x* are closed, and the path R3*x* is opened at the branch position A2. Accordingly, the sheet P having been conveyed from the sheet storage 3 to the branch portion A2 is conveyed to the module path Rc along the path R3*x*.

When the pivot member 28*c*1 is located at the first position, the paths R1*x*-R3*x* are opened, and the path R4*x* is closed at the branch position A3. Accordingly, the sheet P having been conveyed from the sheet storage 3 to the branch portion A3 is conveyed to the branch position A2 along the shared portion of the paths R1*x*-R3*x*. When the pivot member 28*c*1 is located at the second position, the paths R1*x*-R3*x* are closed, and the path R4*x* is opened at the branch position A3. Accordingly, the sheet P having been conveyed from the sheet storage 3 to the branch portion A3 is conveyed to the module path Rd along the path R4*x*.

A first sensor 5 is disposed between the sheet-supply roller 22 and the roller pair 26*d* at a position opposite the shared portion of the paths R1*x*-R4*x*. Second sensors 6*a*-6*d* are disposed opposite the respective downstream end portions of the paths R1*x*-R4*x*.

Each of the first sensor 5 and the second sensors 6*a*-6*d* is configured to output a signal indicating the presence or absence of the sheet P at a corresponding one of a first sensing position 5*p* and second sensing positions 6*ap*-6*dp*. Each of the first sensor 5 and the second sensors 6*a*-6*d* outputs an ON signal when there is a sheet P at the corresponding position, and outputs an OFF signal when there is no sheet P at the corresponding position. The first sensing position 5*p* is determined at a position near the shared portion of the paths R1*x*-R4*x* between the sheet-supply roller 22 and the roller pair 26*d*. Each of the second sensing positions 6*ap*-6*dp* is determined at a position near a corresponding one of the respective downstream end portions of the paths R1*x*-R4*x*. In other words, the second sensing positions 6*ap*-6*dp* are respectively determined at a position on the path R1*x* which is located downstream of the branch position A1, a position on the path R2*x* which is located downstream of the branch position A1, a position on the path R3*x* which is located downstream of the branch position A2, and a position on the path R4*x* which is located downstream of the branch position A3.

Each of the sensors 5, 6*a*-6*d* includes an ON counter and an OFF counter. When an ON signal is output, the ON counter produces a counter pulse which is proportional to an amount of rotation of the upstream conveying motor 26M and starts counting the number of pulses, and when another ON signal is thereafter output, the ON counter resets the count. When an OFF signal is output, the OFF counter produces a counter pulse which is proportional to an amount of rotation of the upstream conveying motor 26M and starts counting the number of pulses, and when another OFF signal is thereafter output, the OFF counter resets the count. Count data created by the ON counter represents an amount of conveyance of the sheet P from the timing when the leading edge of the sheet P has reached a sensing position of a corresponding one of the sensors 5, 6*a*-6*d*. Count data created by the OFF counter represents an amount of conveyance of the sheet P from the timing when the trailing edge of the sheet P has reached the sensing position of the corresponding one of the sensors 5, 6*a*-6*d*.

In the present embodiment, it is possible to assume, as a first assumption, that the recording module 50*a* corresponds to a first recording module, the recording module 50*b* to a second recording module, the recording module 50*c* to a third recording module, the path R1*x* to a first path, the path R2*x* to a second path, the path R3*x* to a third path, the branch position A1 to a first branch position, the branch position A2 to a second branch position, the switcher 28*a* to a first switcher, the switcher 28*b* to a second switcher, the roller pair 26*a* to a first roller pair, the roller pair 26*b* to a second roller pair, and the roller pair 26*c* to a third roller pair. In the first assumption, the upstream portion of the path R2*x* includes a first shared portion shared with the path R1*x*, and the path R2*x* is branched off from the path R1*x* at the branch position A1 provided on one end portion of the first shared portion. The upstream portion of the path R3*x* includes a second shared portion shared with the first shared portion, and the path R3*x* is branched off from the first shared portion at the branch position A2 provided on one end portion of the second shared portion. The roller pair 26*a* is disposed downstream of the branch position A1 on the path R1*x*. The roller pair 26*b* is disposed on the first shared portion (i.e., the shared portion of the paths R1*x*, R2*x*). The roller pair 26*c* is disposed on the second shared portion (i.e., the shared portion of the paths R2*x*, R3*x*) at a position located upstream of the branch position A2. The roller pair 26*b* is disposed on the path R2*x* at a position downstream of the branch position A2 and upstream of the branch position A1.

Alternatively, in the present embodiment, it is possible to assume, as a second assumption, that the recording module 50*b* corresponds to the first recording module, the recording module 50*c* to the second recording module, the recording module 50*d* to the third recording module, the path R2*x* to the first path, the path R3*x* to the second path, the path R4*x* to the third path, the branch position A2 to the first branch position, the branch position A3 to the second branch position, the switcher 28*b* to the first switcher, the switcher 28*c* to the second switcher, the roller pair 26*b* to the first roller pair, the roller pair 26*c* to the second roller pair, and the roller pair 26*d* to the third roller pair. In the second assumption, the upstream portion of the path R3*x* includes a first shared portion shared with the path R2*x*, and the path R3*x* is branched off from the path R2*x* at the branch position A2 provided on one end portion of the first shared portion. The upstream portion of the path R4$x$ includes a second shared portion shared with the first shared portion, and the path R4$x$ is branched off from the first shared portion at the branch position A3 provided on one end portion of the second shared portion. The roller pair 26$b$ is disposed downstream of the branch position A2 on the path R2$x$. The roller pair 26$c$ is disposed on the first shared portion (i.e., the shared portion of the paths R2$x$, R3$x$). The roller pair 26$d$ is disposed on the second shared portion (i.e., the shared portion of the paths R3$x$, R4$x$) at a position located upstream of the branch position A3. The roller pair 26$c$ is disposed on the path R3$x$ at a position downstream of the branch position A3 and upstream of the branch position A2.

The paths R1$y$-R4$y$ extend from the respective downstream end portions of the module paths Ra-Rd to the sheet receiver 4. The paths R1$y$, R2$y$ extend from the respective downstream end portions of the module paths Ra, Rb, then merge with each other at a joining position B1, and extend from the joining position B1 to the sheet receiver 4 by the same route. The paths R2$y$, R3$y$ extend from the respective downstream end portions of the module paths Rb, Rc, then merge with each other at a joining position B2, and extend from the joining position B2 to the sheet receiver 4 by the same route. The paths R3$y$, R4$y$ extend from the respective downstream end portions of the module paths Rc, Rd, then merge with each other at a joining position B3, and extend from the joining position B3 to the sheet receiver 4 by the same route.

The downstream unit 31 includes the roller pairs 36$a$-36$d$, a roller pair 36$e$, and guides 33, 35$a$-35$d$.

Each of the roller pairs 36$a$-36$e$ has two rollers contacting each other and conveys the sheet P, with the two rollers nipping the sheet P therebetween. One of the two rollers of each of the roller pairs 36$a$-36$e$ is a drive roller which is rotated by a downstream conveying motor 36M (see FIG. 6) driven by the controller 100. The other of the two rollers of each of the roller pairs 36$a$-36$e$ is a driven roller which is rotated, in a direction reverse to a direction of the rotation of the drive roller, by the rotation of the drive roller while contacting the drive roller. As a result, the sheet P conveyed from any of the module paths Ra-Rd is conveyed to the sheet receiver 4. The roller pairs 36$a$-36$e$ are driven in synchronization with each other by the downstream conveying motor 36M.

Each of the guides 33, 35$a$-35$d$ defines a corresponding one or ones of the paths R1$y$-R4$y$ and includes a pair of plates arranged spaced apart from each other. The guides 35$a$-35$d$ extend in the horizontal direction and define the respective upstream portions of the paths R1$y$-R4$y$. The guide 33 extends obliquely with respect to the vertical direction and defines the downstream portions of the respective paths R1$y$-R4$y$. The guide 35$d$ is connected to the other end portion of the guide 33 from the sheet receiver 4, and the guides 35$a$-35$c$ are connected to the guide 33 other than its end portions.

Each of the sheet storage 3 and the sheet receiver 4 is mountable on and removable from the housing 1$a$ in a sub-scanning direction. The sheet storage 3 is a tray opening upward and can store a plurality of sheets P. The sheet receiver 4 is a tray opening upward and can receive or support a plurality of sheets P. Each of the sheet storage 3 and the sheet receiver 4 can store or receive the sheets P of various sizes including the postcard size, the A6 size, the A4 size, the letter size, and the A3 size.

In the present embodiment, the sheet P of the A3 size is one example of a first recording medium, and the sheet P of the A4 size or the letter size is one example of a second recording medium. Also, the length of the sheet P (i.e., the length of the sheet P in a direction D along the module paths Ra-Rd) is one example of the length of the recording medium.

The sub-scanning direction is parallel with the horizontal plane and parallel with the respective downstream portions of the paths R1$x$-R4$x$, the module paths Ra-Rd, and the respective upstream portions of the paths R1$y$-R4$y$. A main scanning direction is a direction parallel with the horizontal plane and perpendicular to the sub-scanning direction. The vertical direction is perpendicular to the sub-scanning direction and the main scanning direction.

The controller 100 includes a central processing unit (CPU) as a computing device, a read only memory (ROM), a random access memory (RAM) including a non-transitory RAM, an application specific integrated circuit (ASIC), an interface (I/F), and an input/output port (I/O). The ROM stores programs to be executed by the CPU, various kinds of fixed data, and other similar data. The RAM temporarily stores data necessary for execution of the programs, such as image data, count data of various counters, and various control flags. The ASIC executes rewriting and sorting of image data and other processings such as a signal processing and an image processing. The interface transmits and receives data to and from an external device such as a PC connected to the printer 1. The input/output port inputs and outputs signals produced by various sensors.

Figure 3:
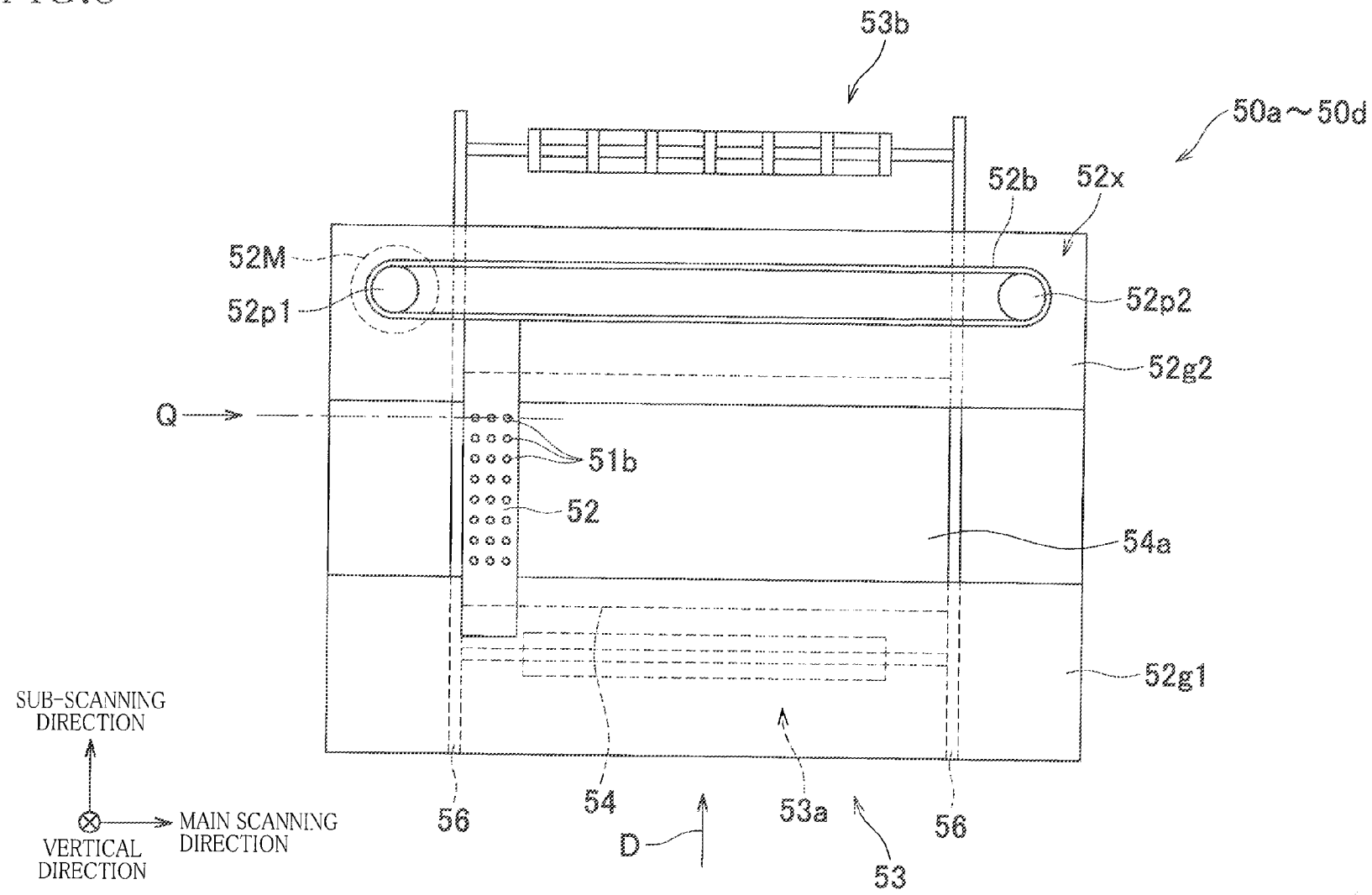
FIG. 3 is a plan view of a recording module of the printer illustrated in FIG. 1.
Figure 4:
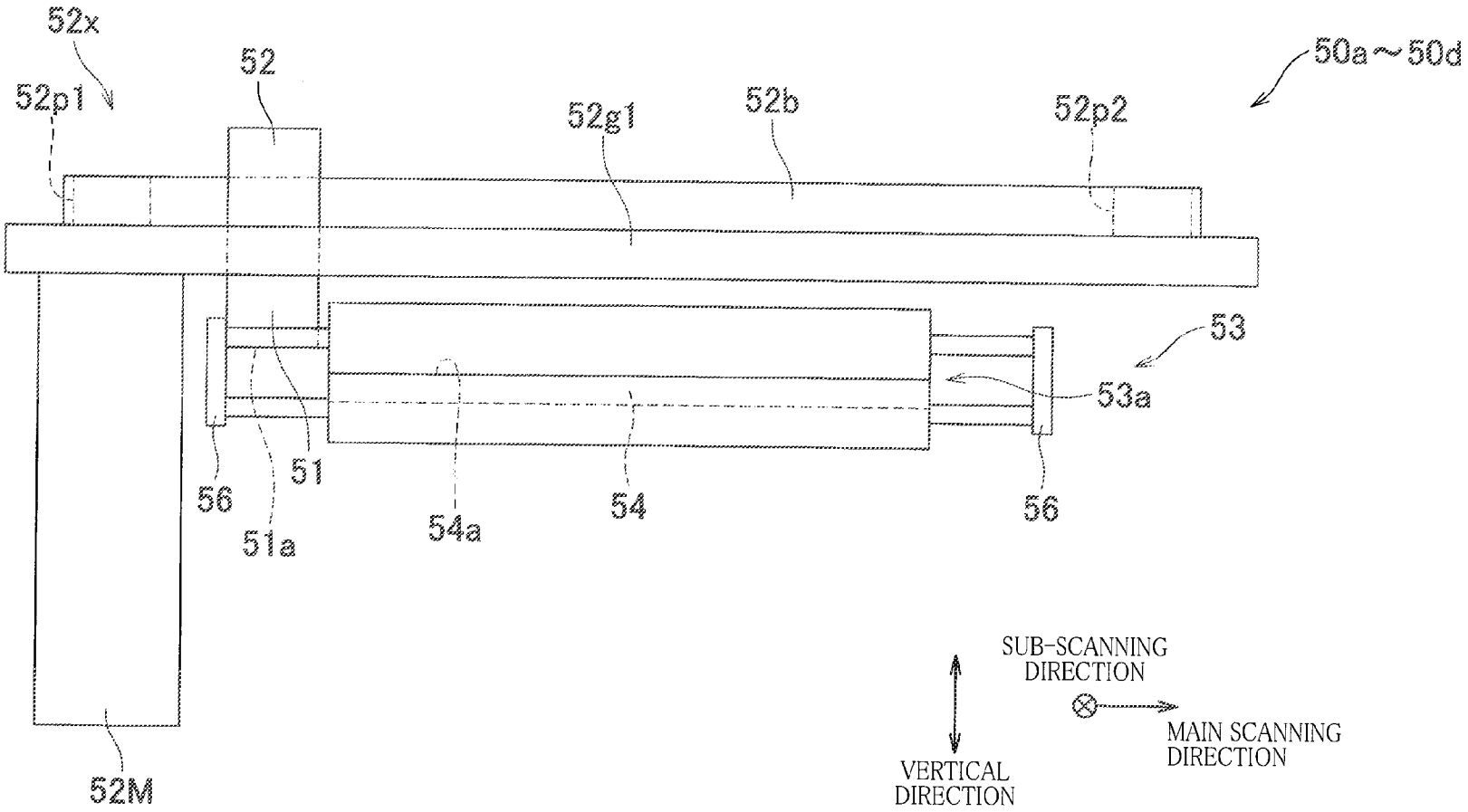
FIG. 4 is a front elevational view of the recording module of the printer illustrated in FIG. 1.
Figure 5:
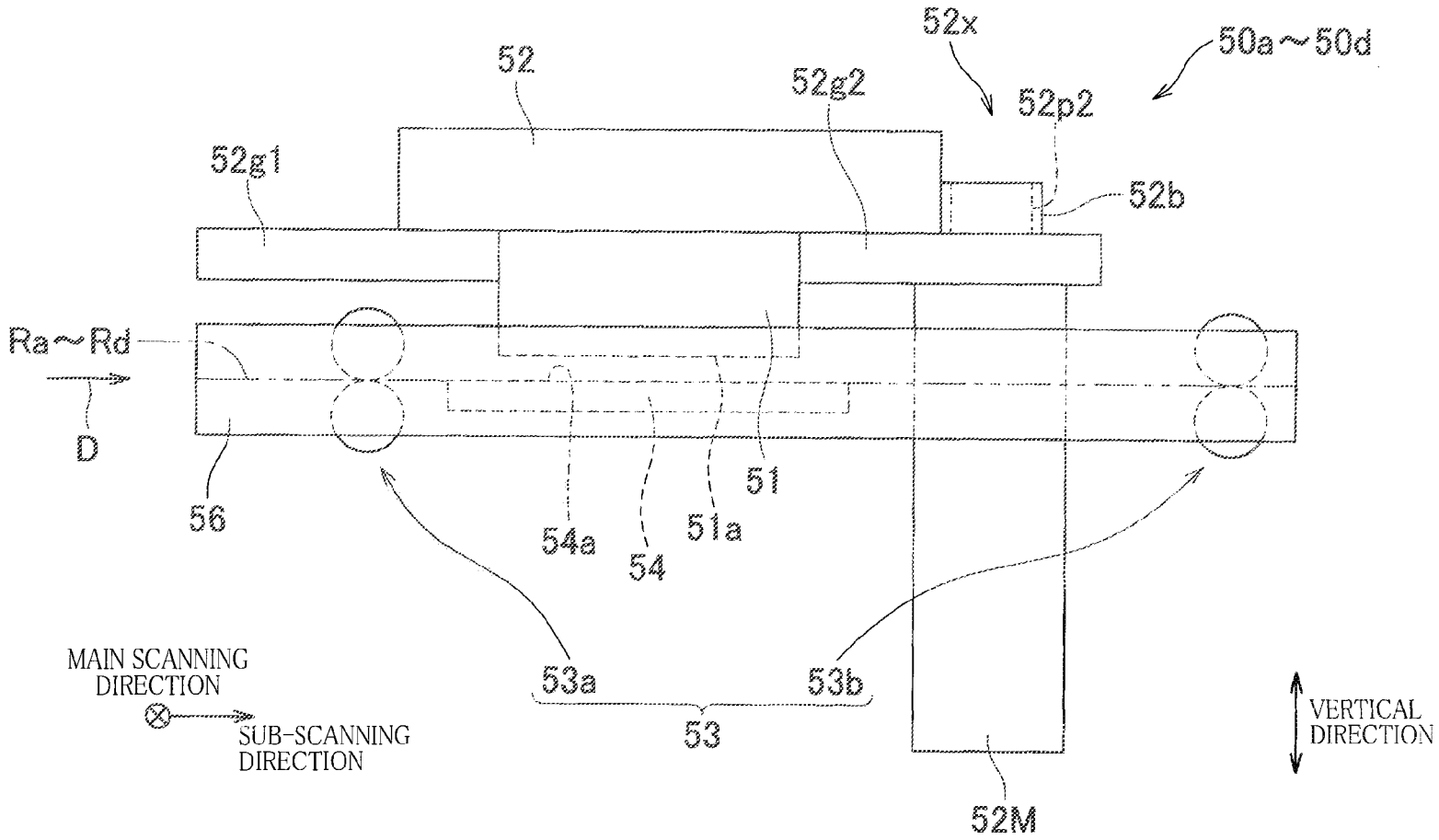
FIG. 5 is a side view of the recording module of the printer illustrated in FIG. 1.

There will be next explained the recording modules 50$a$-50$d$ with reference to FIGS. 3-5.

Each of the recording modules 50$a$-50$d$ includes the head 51, a carriage 52, and an individual conveyor 53.

The head 51 is a serial head having a generally rectangular parallelepiped shape and supported by the housing 1$a$ via the carriage 52. An upper surface of the head 51 is fixed to the carriage 52. A lower surface of the head 51 is an ejection surface 51$a$ having the plurality of ejection openings 5$b$ opening therein.

The carriage 52 is reciprocable in the main scanning direction by a carriage moving device 52$x$. The carriage 52 supports the head 51 and reciprocates the head 51 in the main scanning direction. The carriage moving device 52$x$ includes guides 52$g$1, 52$g$2, pulleys 52$p$1, 52$p$2, a belt 52$b$, and a carriage motor 52M. Each of the guides 52$g$1, 52$g$2 has a rectangular shape when viewed in the vertical direction, and the guides 52$g$1, 52$g$2 are spaced apart from each other in the sub-scanning direction.

An upper portion of the head 51 is interposed between the guides 52$g$1, 52$g$2 which respectively support opposite ends of the carriage 52 in the sub-scanning direction such that the carriage 52 is slidable in the main scanning direction. The pulleys 52$p$1, 52$p$2 are rotatably supported by opposite end portions of the guide 52$g$2 in the main scanning direction. The pulleys 52$p$1, 52$p$2 have the same diameter and are arranged at the same position in the sub-scanning direction. The belt 52$b$ is an endless belt looped over the pulleys 52$p$1, 52$p$2 and travels by the rotation of the pulleys 52$p$1, 52$p$2. The carriage 52 is fixed to the belt 52$b$. The carriage motor 52M has a circular cylindrical shape elongated in the vertical direction and is fixed to a lower surface of the guide 52$g$2. A rotation shaft of the carriage motor 52M is mounted on the pulley 52$p$1 so as to extend in the vertical direction.

The pulley 52$p$1 is a drive pulley which is rotated forwardly and reversely by the carriage motor 52M driven by the controller 100. The rotation of the pulley 52$p$1 rotates the belt 52$b$. The pulley 52$p$2 is a driven pulley which is rotated by the rotation of the belt 52$b$. With the operations of the components and devices of the carriage moving device 52$x$, the carriage 52 supporting the head 51 is reciprocated in the main scanning direction. During this reciprocation, the controller 100 controls the head 51 to eject the ink from the ejection openings 51*b* at desired timings to record an image on the sheet P.

Each of the individual conveyors 53 is configured to intermittently convey the sheet P along the corresponding one of the module paths Ra-Rd in the direction D and includes roller pairs 53*a*, 53*b* and an individual conveying motor 53M (see FIG. 6). The roller pairs 53*a*, 53*b* are rotated by the individual conveying motor 53M driven by the controller 100. This rotation conveys the sheet P in the direction D. The direction D is a direction parallel with the sub-scanning direction and directed from an upstream side to a downstream side of each of the module paths Ra-Rd. The roller pairs 53*a*, 53*b* extend in the main scanning direction and interpose the head 51 in the sub-scanning direction. That is, in each of the module paths Ra-Rd, the roller pair 53*a* is disposed upstream of the head 51, and the roller pair 53*b* is disposed downstream of the head 51.

In the present embodiment, the sub-scanning direction is one example of a first direction, and the direction D is one example of a second direction.

A platen 54 is disposed between the roller pairs 53*a*, 53*b* at a position opposite the ejection surface 51*a*. The platen 54 has a flat upper surface 54*a* which can support a lower surface of the sheet P. A space appropriate for recording is formed between the ejection surface 51*a* and the upper surface 54*a*.

The roller pairs 53*a*, 53*b* and the platen 54 are supported by a pair of flanges 56. The pair of flanges 56 extending in the sub-scanning direction are spaced apart from each other in the main scanning direction.

An upper one of two rollers of the roller pair 53*b* is a spur roller provided with a plurality of spurs, in order not to deteriorate the image recorded on the sheet P when the roller pair 53*b* nips the sheet P.

The controller 100 controls each of the recording modules 50*a*-50*d* to perform (i) an intermittently conveying operation in which the sheet P is intermittently conveyed in the direction D by the corresponding individual conveyor 53 and (ii) a reciprocating operation in which, during a conveyance stopped period in which the sheet P is stopped in the intermittently conveying operation, the ink is ejected from the ejection openings 51*b* while the carriage 52 is reciprocated in the main scanning direction.

The roller pair 53*b* is a one-way roller. That is, rotational power of the roller pair 53*a* is transmitted to the roller pair 53*b*, but rotational power of the roller pair 53*b* is not transmitted to the roller pair 53*a*. Accordingly, while the image-recorded sheet P is successively conveyed toward the sheet receiver 4 by successive drivings of the roller pair 53*b*, the next sheet P can be intermittently conveyed in a corresponding one of the module paths Ra-Rd by intermittent drivings of the roller pair 53*a*. This configuration can improve a throughput. In a configuration in which the roller pair 53*b* is not the one-way roller, but the roller pairs 53*a*, 53*b* are driven in complete synchronization with each other, unlike the present embodiment, when a leading edge of the next sheet P reaches the roller pair 53*a* in the corresponding one of the module paths Ra-Rd before a trailing edge of the sheet P reaches a downstream side of the roller pair 53*b*, the roller pairs 53*a*, 53*b* are both driven intermittently, so that the image-recorded sheet P cannot be successively conveyed toward the sheet receiver 4 by the roller pair 53*a*.

There will be next explained processings to be executed by the controller 100 with reference to FIGS. 7-10.

When a recording command is received from the external device, the controller 100 initially determines which recording module the sheet P is to be supplied to (that is, the controller determines a destination of supply of the sheet P) by referring to information contained in the recording command which represents the size and the number of sheets P and to a table representing correspondence between a destination of the supply and the size and the number of sheets P. The table is stored in the ROM, for example.

The recording modules 50*a*-50*d* are used in order from the top, i.e., the upper recording module in the case where the sheet P is of the A4 size or the letter size. Specifically, in a case where recording is successively performed on a plurality of sheets P of the A4 size or the letter size, the first sheet P is supplied to the recording module 50*a*, the second sheet P to the recording module 50*b*, the third sheet P to the recording module 50*c*, and the fourth sheet P to the recording module 50*d*. That is, in the case where the sheet P is of the A4 size or the letter size, the 4m+1th sheet P (n=4m+1 (m is an integer greater than or equal to zero)) is supplied to the uppermost recording module 50*a*, the 4m+2th sheet P (n=4m+2) to the second recording module 50*b* from the top, the 4m+3th sheet P (n=4m+3) to the third recording module 50*c* from the top, and the 4m+4th sheet P (n=4m+4) to the fourth recording module 50*d* from the top (see FIG. 11).

Figure 11:
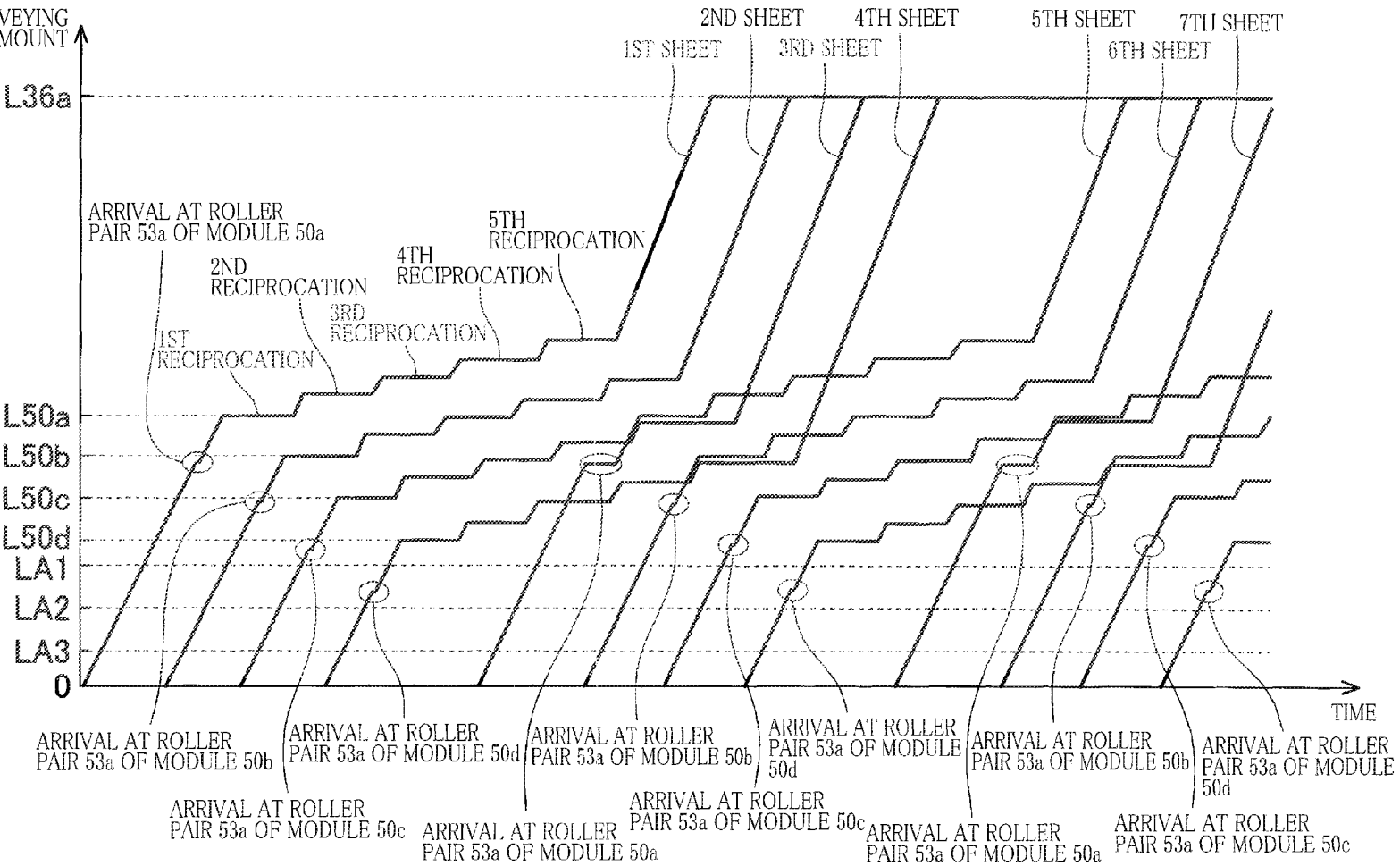
FIG. 11 is a diagram illustrating conveyance of sheets in a case where recording is successively performed on a plurality of sheets of the A4 size or the letter size.

FIG. 11 illustrates a situation of conveyance of sheets P in a case where recording is successively performed on seven sheets P of the A4 size or the letter size, with the horizontal axis representing time, and the vertical axis representing an amount of conveyance of the sheet P. The starting point (i.e., the origin point 0) of the vertical axis is the sheet storage 3. The characters "L36*a*" represent a distance from the sheet storage 3 to the roller pair 36*a* along the corresponding path. Each of the characters "L50*a*"-"L50*d*" represents a distance from the sheet storage 3 to a recording starting position in a corresponding one of the recording modules 50*a*-50*d* along the corresponding path. Each of the characters "LA1"-"LA3" represents a distance from the sheet storage 3 to a corresponding one of the branch positions A1-A3 along the corresponding path.

In the case where the sheet P is of the A3 size, the uppermost recording module 50*a* and the third recording module 50*c* from the top are repeatedly used in this order. Specifically, in a case where recording is successively performed on a plurality of sheets P of the A3 size, the first sheet P is supplied to the recording module 50*a*, the second sheet P to the recording module 50*c*, the third sheet P to the recording module 50*a*, and the fourth sheet P to the recording module 50*c*. That is, in the case where the sheet P is of the A3 size, the 4m+1th sheet P (n=4m+1) or the 4m+3th sheet P (n=4m+3) is supplied to the uppermost recording module 50*a*, and the 4m+2th sheet P (n=4m+2) or the 4m+4th sheet P (n=4m+4) is supplied to the third recording module 50*c* from the top.

After determination of the destination of supply of the sheet P, the controller 100 executes a recording module control routine (see FIGS. 7 and 8), a switcher control routine (see FIG. 9), an upstream roller control routine (see FIG. 10), and a downstream roller control routine, not shown, in parallel. The recording module control routine includes: a control to be executed for upstream rollers (including the sheet-supply roller 22 and the roller pairs 26*a*-26*d*), the switchers 28*a*-28*c*, and so on when the sheet P is conveyed from the sheet storage 3 toward a corresponding one of the recording modules 50*a*-50*d* as the destination of supply of the sheet P; and a control for the intermittently conveying operation and the reciprocating operation performed by the corresponding one of the recording modules 50*a*-50*d*. This recording module control routine is executed for the recording modules 50*a*-50*d* in parallel. The switcher control routine includes a control for switch of the position of each of the pivot members 28*a*1-28*c*1 of the switchers 28*a*-28*c* and is executed for the switchers 28*a*-28*c* in parallel. The upstream roller control routine includes a control for driving and stopping the upstream rollers. The downstream roller control routine includes a control for driving the downstream rollers (including the roller pairs 36*a*-36*e*). In the downstream roller control routine, the controller 100 controls the downstream conveying motor 36M to drive the downstream rollers to convey the sheet P along a corresponding one of the paths R1*y*-R4*y* onto the sheet receiver 4.

Figure 7:
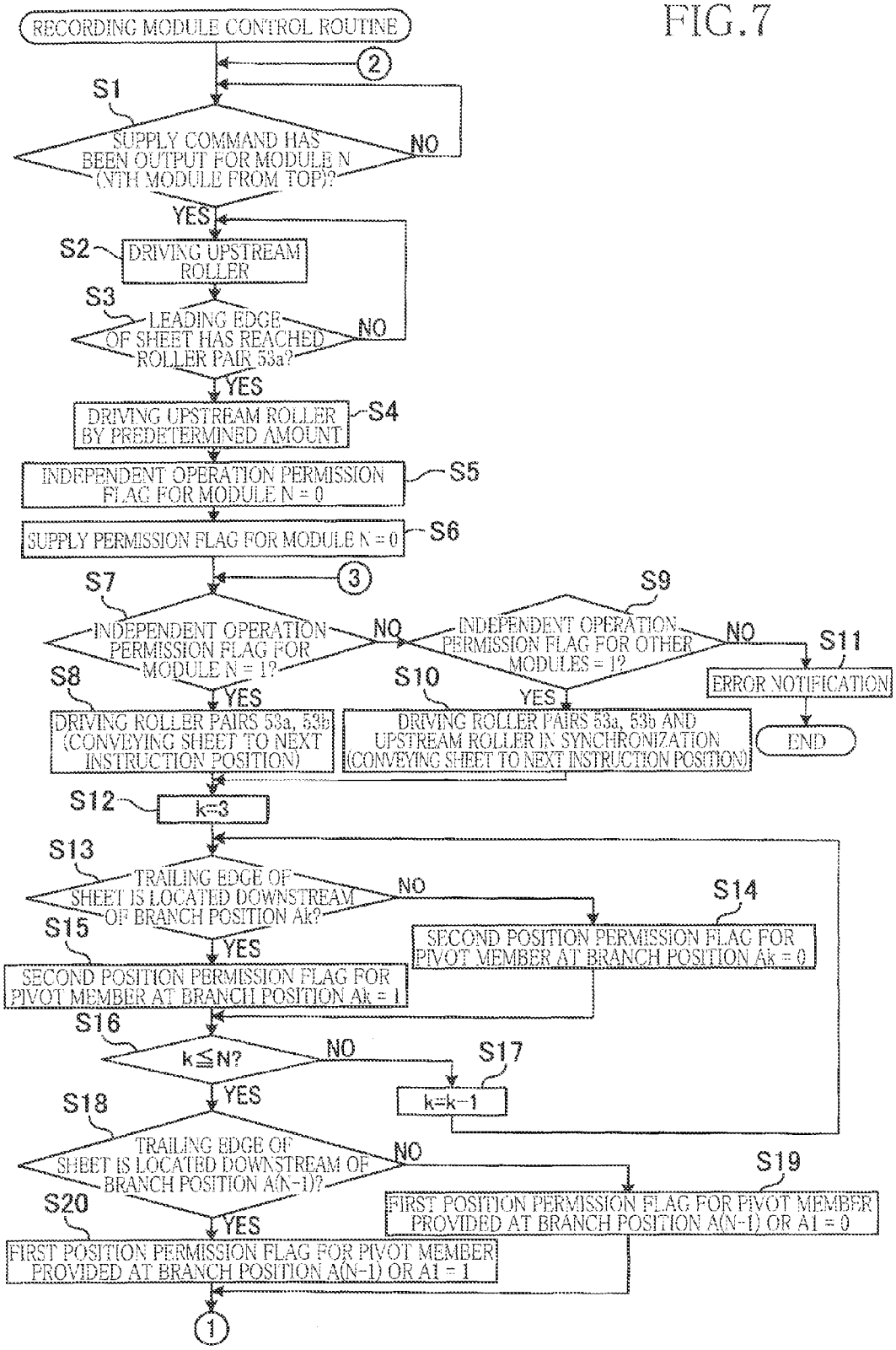
FIG. 7 is a flow chart illustrating a first portion of a recording module control routine to be executed by a controller of the printer illustrated in FIG. 1.

In the recording module control routine, as illustrated in FIG. 7, this flow begins with S1 at which the controller 100 determines whether a supply command has been output for the module N or not. The module N is an Nth recording module from the top among the recording modules 50*a*-50*d*. In the present embodiment, the recording module control routine is executed for the case where the variable N is 1, 2, 3, or 4.

When the supply command is not output for the module N (S1: NO), the controller 100 repeats the processing at S1. When the supply command is output for the module N (S1: YES), the controller 100 at S2 controls the sheet-supply motor 22M and the upstream conveying motor 26M to drive the upstream rollers to supply a sheet P to the module N. As a result, the sheet P stored in the sheet storage 3 is conveyed by the sheet-supply roller 22 and a corresponding one of the roller pairs 26*a*-26*d* along a corresponding one of the paths R1*x*-R4*x* to the module path (i.e., a corresponding one of the module paths Ra-Rd) of the module N.

After S2, the controller 100 at S3 determines, based on the signal output from the first sensor 5, whether a leading edge of the sheet P has reached the roller pair 53*a* of the module N or not. That is, the controller determines whether or not an amount of conveyance of the sheet P from the point in time when the leading edge of the sheet P has reached the first sensing position 5*p* has reached a distance or amount Lx between the first sensing position 5*p* and the roller pair 53*a* along the corresponding path. The amount of conveyance of the sheet P from the point in time when the leading edge of the sheet P has reached the first sensing position 5*p* is calculated based on the count data created by the ON counter of the first sensor 5. In FIG. 1, the distance Lx represents a distance along the path R1*x* between the first sensing position 5*p* and the roller pair 53*a* for the recording module 50*a*.

When the leading edge of the sheet P has not reached the roller pair 53*a* of the module N (S3: NO), this flow returns to S2. When the leading edge of the sheet P has reached the roller pair 53*a* of the module N (S3: YES), the controller 100 at S4 controls the sheet-supply motor 22M and the upstream conveying motor 26M to drive the upstream rollers by a predetermined amount to cause a particular bend on the sheet P.

After S4, the controller 100 at S5 sets an independent operation permission flag for the module N to 0. The controller 100 at S6 sets a supply permission flag for the module N to 0. In the case where the independent operation permission flag for the module N is 0, the roller pair 53*a* of the module N and the upstream rollers are nipping the same sheet P at the same time and accordingly need to be driven in synchronization with each other. In the case where the independent operation permission flag for the module N is 1, the roller pair 53*a* of the module N and the upstream rollers are not nipping the same sheet P at the same time and accordingly can be driven independently of each other. In the case where the supply permission flag for the module N is 0, the roller pair 53*a* of the module N is nipping the sheet P, and accordingly the controller 100 cannot execute a processing for conveying another sheet P to the roller pair 53*a*. In the case where the supply permission flag for the module N is 1, the roller pair 53*a* of the module N is not nipping the sheet P, and accordingly the controller 100 can execute the processing for conveying another sheet P to the roller pair 53*a*.

After S6, the controller 100 at S7 determines whether the independent operation permission flag for the module N is 1 or not. When the independent operation permission flag for the module N is 1 (S7: YES), the controller 100 at S8 controls the individual conveying motor 53M for the module N to drive the roller pairs 53*a*, 53*b* for the module N to convey the sheet P to the next instruction position. The next instruction position at the processing S8 executed for the first time is a position at which a leading edge portion of an image recording area on the sheet P is opposite the head 51, and the next instruction position at the processing S8 executed for the second or subsequent time is a position at which the sheet P has been moved forward by an amount corresponding to a single operation of the intermittently conveying operation.

When the independent operation permission flag for the module N is not 1 (S7: NO), the controller 100 at S9 determines whether the independent operation permission flag is 1 or not for each of all the recording modules other than the module N. When the independent operation permission flag is 1 for each of all the recording modules other than the module N (S9: YES), the controller 100 at S10 controls the individual conveying motor 53M for the module N and the upstream conveying motor 26M to drive the roller pairs 53*a*, 53*b* for the module N and the upstream rollers in synchronization with each other to convey the sheet P to the next instruction position.

When the independent operation permission flag is not 1 for any of the recording modules other than the module N (S9: NO), the controller 100 at S11, for example, controls a voice output device (e.g., a speaker) and an image output device (e.g., a display) provided on the printer 1, to output a voice and an image for error notification. After S1, the controller 100 finishes all the controls including this recording module control routine and stops the operation of the printer 1.

After S8 or S10, the controller 100 at S12 sets a variable k to 3 (k=3). After S12, the controller 100 at S13 determines, based on the signal output from the first sensor 5, whether a trailing edge of the sheet P is located downstream of a branch position Ak on the corresponding path or not. That is, the controller 100 determines whether an amount of conveyance of the sheet P from the point in time when the trailing edge of the sheet P has reached the first sensing position 5*p* has exceeded a distance or amount Ly between the first sensing position 5*p* and the branch position Ak along the corresponding path or not. The amount of conveyance of the sheet P from the point in time when the trailing edge of the sheet P has reached the first sensing position 5*p* is calculated based on the count data created by the OFF counter of the first sensor 5. In FIG. 1, the distance Ly is a distance between the first sensing position 5*p* and the branch position A1 along the path R1*x*.

When the trailing edge of the sheet P is located downstream of the branch position Ak on the corresponding path (S13: NO), the controller 100 at S14 sets a second position permission flag for one of the pivot members 28*a*1-28*c*1 which is provided at the branch position Ak to 0. When the trailing edge of the sheet P is located downstream of the branch position Ak on the corresponding path (S13: YES), the controller 100 at S15 sets the second position permission flag for one of the pivot members 28*a*1-28*c*1 which is provided at the branch position Ak to 1. In the case where the second position permission flag for one of the pivot members 28*a*1-28*c*1 which is provided at the branch position Ak is 0, the sheet P is present between the inner wall of the guide 23 and a distal end of the one of the pivot members 28*a*1-28*c*1, and when the one of the pivot members 28*a*1-28*c*1 which is provided at the branch position Ak is moved to the second position, the sheet P is nipped between the inner wall of the guide 23 and the distal end of the one of the pivot members 28*a*1-28*c*1, and accordingly the one of the pivot members 28*a*1-28*c*1 cannot be moved to the second position. In the case where the second position permission flag for one of the pivot members 28*a*1-28*c*1 which is provided at the branch position Ak is 1, no sheet P is present between the inner wall of the guide 23 and the distal end of the one of the pivot members 28*a*1-28*c*1, and accordingly the one of the pivot members 28*a*1-28*c*1 can be moved to the second position.

After S14 or S15, the controller 100 at S16 determines whether or not the variable k is smaller than or equal to the variable N (k≤N). When the variable k is not smaller than or equal to the variable N (S16: NO), the controller 100 at S17 sets the variable k to k−1 (k=k−1), and this flow returns to S13. When the variable k is smaller than or equal to the variable N (516: YES), as in the processing at S13, the controller 100 at S18 determines, based on the signal output from the first sensor 5, whether the trailing edge of the sheet P is located downstream of a branch position A(N−1) (noted that this branch position A(N−1) is the branch position A1 in the case where the variable N is 1 (N=1)) on the corresponding path or not.

When the trailing edge of the sheet P is not located downstream of the branch position A(N−1) on the corresponding path (S18: NO), the controller 100 at S19 sets a first position permission flag for one of the pivot members 28*a*1-28*c*1 which is provided at the branch position A(N−1), to 0. When the trailing edge of the sheet P is located downstream of the branch position Ak on the corresponding path (S13: YES), the controller 100 at S20 sets the first position permission flag for the one of the pivot members 28*a*1-28*c*1 which is provided at the branch position A(N−1), to 1.

Figure 8:
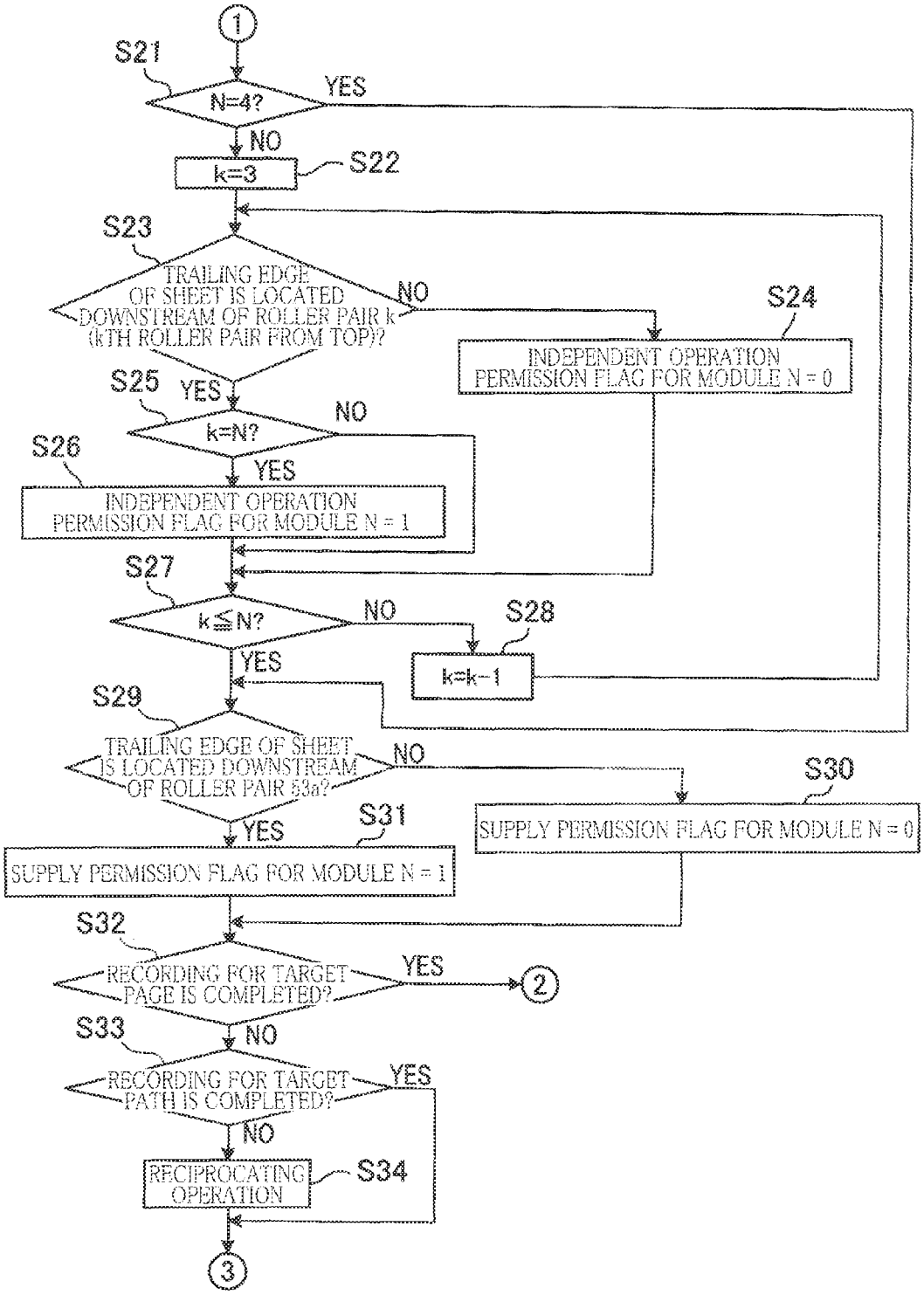
FIG. 8 is a flow chart illustrating a second portion of the recording module control routine to be executed by the controller of the printer illustrated in FIG. 1.

After S19 or S20, as illustrated in FIG. 8, the controller 100 at S21 determines the variable N is 4 (N=4) or not. When the variable N is 4 (S21: YES), this flow goes to S29.

When the variable N is not 4 (S21: NO), the controller 100 at S22 sets the variable k to 3 (k=3). After S22, the controller 100 at S23 determines, based on the signal output from the first sensor 5, whether the trailing edge of the sheet P is located downstream of a roller pair k on the corresponding path or not. That is, the controller 100 determines whether the amount of conveyance of the sheet P from the point in time when the trailing edge of the sheet P has reached the first sensing position 5*p* has exceeded a distance or amount Lz between the first sensing position 5*p* and the roller pair k along the corresponding path or not. The roller pair k is a kth roller pair from the top among the roller pairs 26*a*-26*c*. In FIG. 1, the distance Lz is a distance between the first sensing position 5*p* and the roller pair 26*a* along the path R1*x*.

When the trailing edge of the sheet P is not located downstream of the roller pair k on the corresponding path (S23: NO), the controller 100 at S24 sets the independent operation permission flag for the module N to 0.

When the trailing edge of the sheet P is located downstream of the roller pair k on the corresponding path (S23: YES), the controller 100 at S25 determines whether the variable k is equal to the variable N (k=N) or not. When the variable k is equal to the variable N (S25: YES), the controller 100 at S26 sets the independent operation permission flag for the module N to 1. When the variable k is not equal to the variable N (S25: NO), this flow goes to S27.

After S24 or S26, the controller 100 at S27 determines whether or not the variable k is smaller than or equal to the variable N. When the variable k is not smaller than or equal to the variable N (S27: NO), the controller 100 at S28 sets the variable k to k−1 (k=k−1), and this flow returns to S23. When the variable k is smaller than or equal to the variable N (S27: YES), the controller 100 at S29 determines, based on the signal output from the first sensor 5, whether the trailing edge of the sheet P is located downstream of the roller pair 53*a* on the corresponding path or not. That is, the controller determines whether the amount of conveyance of the sheet P from the point in time when the trailing edge of the sheet P has reached the first sensing position 5*p* has exceeded the distance Lx or not.

When the trailing edge of the sheet P is not located downstream of the roller pair 53*a* on the corresponding path (S29: NO), the controller 100 at S30 sets the supply permission flag for the module N to 0. When the trailing edge of the sheet P is located downstream of the roller pair 53*a* on the corresponding path (S29: YES), the controller 100 at S31 sets the supply permission flag for the module N to 1.

After S30 or S31, the controller 100 at S32 refers to the image data contained in the recording command to determine whether recording for a target page is completed or not. That is, the controller determines whether or not recording is completed for a front surface of the sheet P which is a surface facing downward in the sheet storage 3 and facing the head 51 during recording. When the recording for the target page is completed (S32: YES), this flow returns to S1.

When the recording for the target page is not completed (S32: NO), the controller 100 at S33 refers to the image data contained in the recording command to determine whether recording for a target path (i.e., a path of the movement of the head 51 during a single reciprocating operation) is completed or not. That is, the controller 100 determines whether or not recording by an amount corresponding to a single reciprocating operation is completed for a portion of the sheet P which faces the head 51 at this point in time.

When the recording for the target path is completed (S33: YES), this flow returns to S7. When the recording for the target path is not completed (S33: NO), the controller 100 at S34 controls the head 51 and the carriage motor 52M for the module N to perform the reciprocating operation, and this flow returns to S7.

Figure 9:
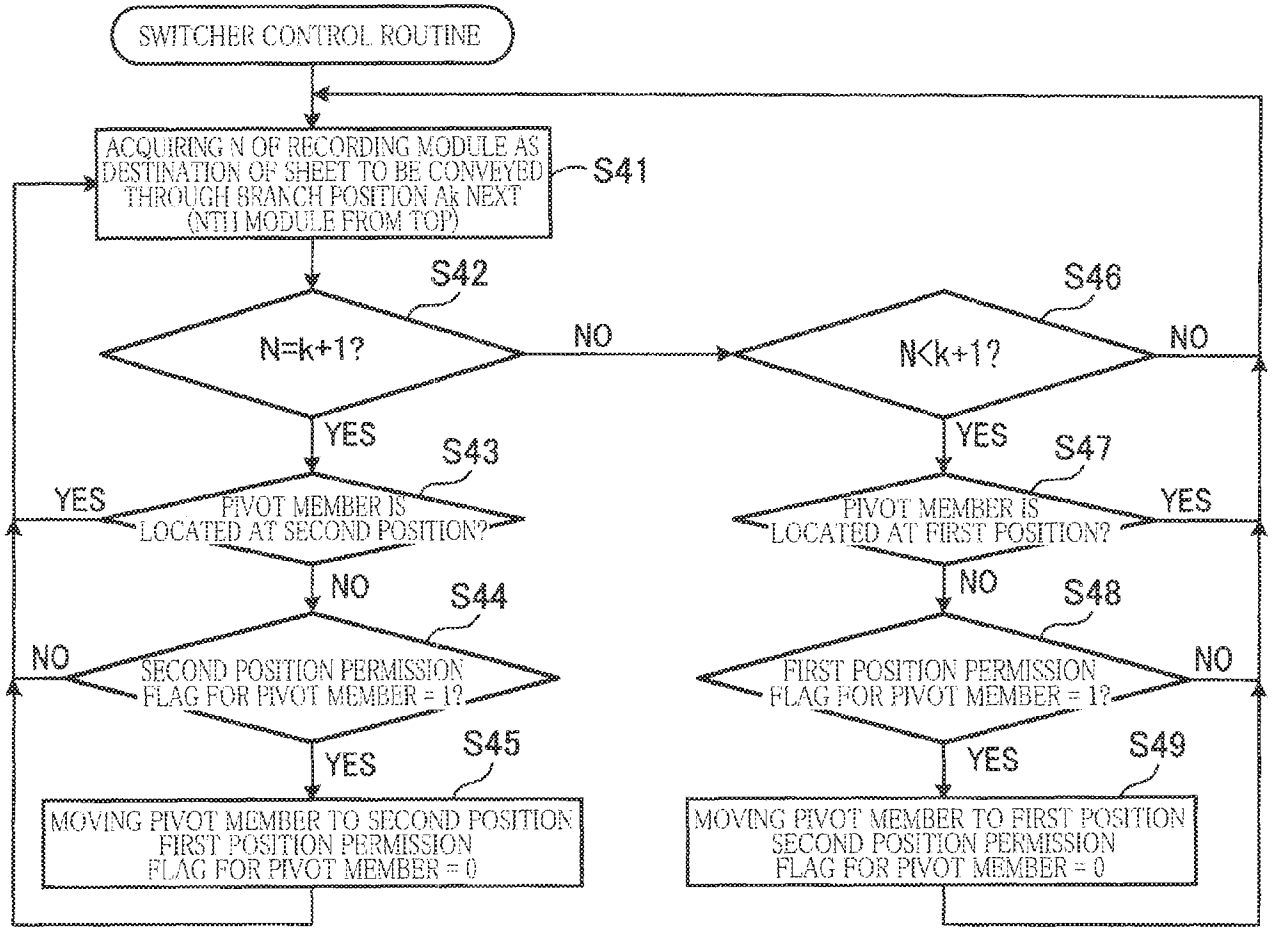
FIG. 9 is a flow chart illustrating a switcher control routine to be executed by the controller of the printer illustrated in FIG. 1.

In the switcher control routine, as illustrated in FIG. 9, this flow begins with S41 at which the controller 100 acquires the number N of the recording module as a destination of supply of the sheet P to be conveyed through the branch position Ak next. The branch position Ak is one of the branch positions A1-A3. In the present embodiment, the switcher control routine is executed in parallel for the cases where the variable k is 1, 2, and 3.

After S41, the controller 100 at S42 determines whether the variable N is equal to the variable k+1 (N=k+1) or not. When the variable N is equal to the variable k+1 (S42: YES), the controller 100 at S43 determines whether one of the pivot members 28*a*1-28*c*1 which is provided at the branch position Ak is located at the second position or not. When the one of the pivot members 28*a*1-28*c*1 which is provided at the branch position Ak is located at the second position (S43: YES), this flow returns to S41. When the one of the pivot members 28*a*1-28*c*1 which is provided at the branch position Ak is not located at the second position (S43: NO), the controller 100 at S44 determines whether the second position permission flag for the one of the pivot members 28*a*1-28*c*1 is 1 or not. When the second position permission flag for the one of the pivot members 28*a*1-28*c*1 which is provided at the branch position Ak is not 1 (S44: NO), this flow returns to S41. When the second position permission flag for the one of the pivot members 28a1-28c1 which is provided at the branch position Ak is 1 (S44: YES), the controller 100 at S45 controls a corresponding one of the switching motors 28aM-28cM to move the one of the pivot members 28a1-28c1 to the second position and sets the first position permission flag for the one of the pivot members 28a1-28c1 to 0. After S45, this flow returns to S41.

When the variable N is not equal to the variable k+1 (S42: NO), the controller 100 at S46 determines whether or not the variable N is smaller than the variable k+1 (N<k+1) or not. When the variable N is not smaller than the variable k+1 (S46: NO), this flow returns to S41. When the variable N is smaller than the variable k+1 (S46: YES), the controller 100 at S47 determines whether the one of the pivot members 28a1-28c1 which is provided at the branch position Ak is located at the first position or not. When the one of the pivot members 28a1-28c1 which is provided at the branch position Ak is located at the first position (S47: YES), this flow returns to S41. When the one of the pivot members 28a1-28c1 which is provided at the branch position Ak is not located at the first position (S47: NO), the controller 100 at S48 determines whether the first position permission flag for the one of the pivot members 28a1-28c1 is 1 or not. When the first position permission flag for the one of the pivot members 28a1-28c1 which is provided at the branch position Ak is not 1 (S48: NO), this flow returns to S41. When the first position permission flag for the one of the pivot members 28a1-28c1 which is provided at the branch position Ak is 1 (S48: YES), the controller 100 at S49 controls a corresponding one of the switching motors 28aM-28cM to move the one of the pivot members 28a1-28c1 which is provided at the branch position Ak to the first position and sets the second position permission flag for the one of the pivot members 28a1-28c1 to 0. After S49, this flow returns to S41.

Figure 10:
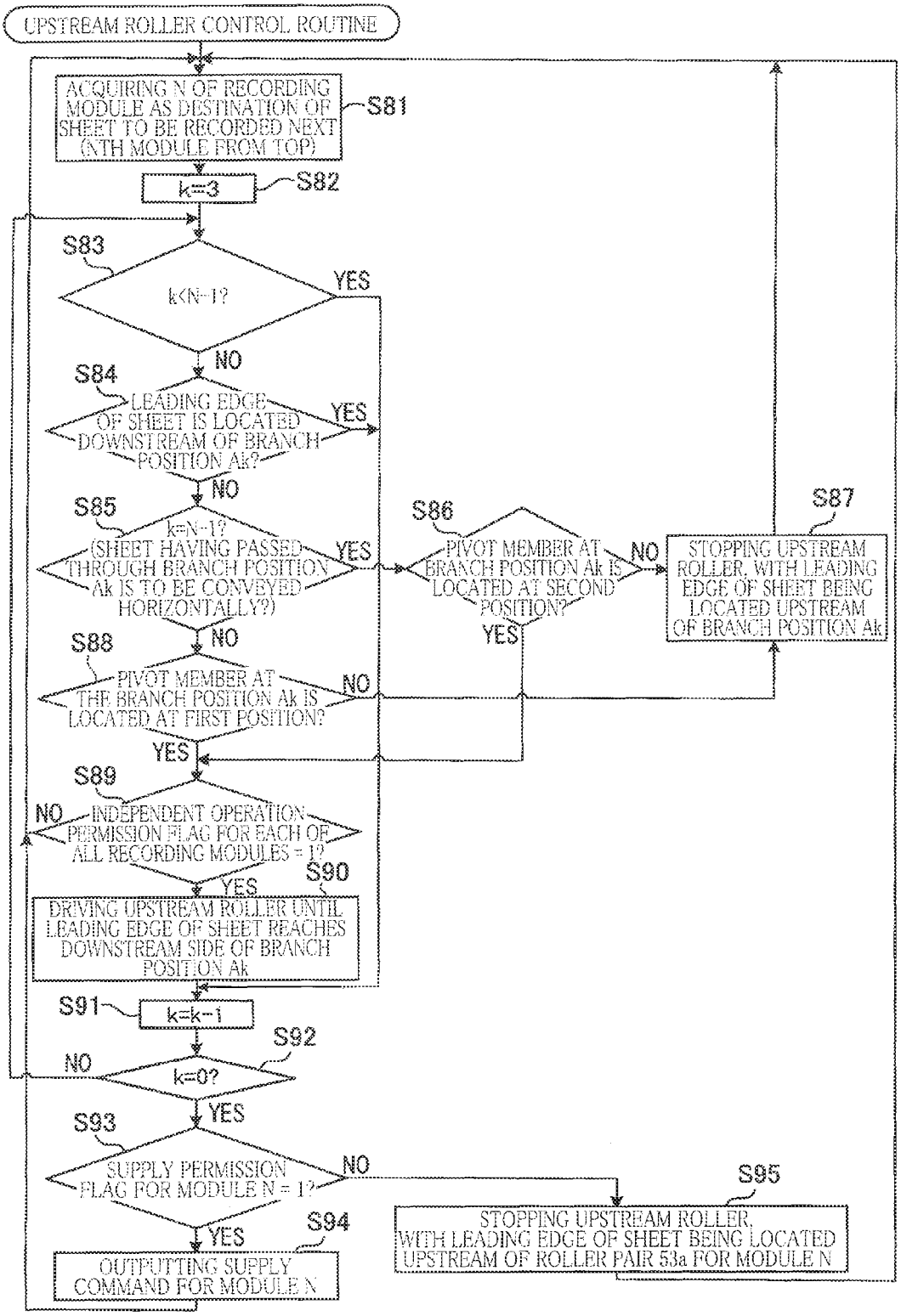
FIG. 10 is a flow chart illustrating an upstream roller control routine to be executed by the controller of the printer illustrated in FIG. 1.

In the upstream roller control routine, as illustrated in FIG. 10, this flow begins with S81 at which the controller 100 acquires the number N of the recording module as a destination of supply of the sheet P on which recording is to be performed next.

After S81, the controller 100 at S82 sets the variable k to 3 (k=3). After S82, the controller 100 at S83 determines whether the variable k is smaller than the variable N−1 (k<N−1) or not. That is, the controller 100 determines whether or not the sheet P on which recording is to be performed next is not to pass through the branch position Ak. When the variable k is smaller than the variable N−1 (S83: YES), that is, when the sheet P on which recording is to be performed next is not to pass through the branch position Ak, this flow goes to S91.

When the variable k is not smaller than the variable N−1 (S83: NO), that is, when the sheet P on which recording is to be performed next is to pass through the branch position Ak, as in the processing at S13, the controller 100 at S84 determines, based on the signal output from the first sensor 5, whether the leading edge of the sheet P is located downstream of the branch position Ak on the corresponding path or not.

When the leading edge of the sheet P is located downstream of the branch position Ak on the corresponding path (S84: YES), this flow goes to S91.

When the leading edge of the sheet P is not located downstream of the branch position Ak on the corresponding path (S84: NO), the controller 100 at S85 determines whether or not the variable k is equal to the variable N−1 (k=N−1). That is, the controller 100 determines whether the sheet P on which recording is to be performed next is to pass through the branch position Ak and thereafter is to be conveyed horizontally to the corresponding module path or not.

When the variable k is equal to the variable N−1 (S85: YES), that is, when the sheet P on which recording is to be performed next is to be horizontally conveyed to the corresponding module path after passing through the branch position Ak, the controller 100 at S86 determines whether the one of the pivot members 28a1-28c1 which is provided at the branch position Ak is located at the second position or not. When the one of the pivot members 28a1-28c1 which is provided at the branch position Ak is located at the second position (S86: YES), this flow goes to S89. When the one of the pivot members 28a1-28c1 which is provided at the branch position Ak is not located at the second position (S86: NO), the controller 100 at S87 controls the upstream conveying motor 26M to stop the upstream rollers in a state in which the leading edge of the sheet P is located upstream of the branch position Ak on the corresponding path. After S87, this flow returns to S81.

When the variable k is not equal to the variable N−1 (S85: NO), that is, when the sheet P on which recording is to be performed next is not to be horizontally conveyed to the corresponding module path after passing through the branch position Ak, the controller 100 at S88 determines whether the one of the pivot members 28a1-28c1 which is provided at the branch position Ak is located at the first position or not. When the one of the pivot members 28a1-28c1 which is provided at the branch position Ak is not located at the first position (S88: NO), this flow goes to S87. When the one of the pivot members 28a1-28c1 which is provided at the branch position Ak is located at the first position (S88: YES), the controller 100 at S89 determines whether the independent operation permission flag for each of all the recording modules 50a-50d is 1 or not.

When the independent operation permission flag for each of all the recording modules 50a-50d is not 1 (that is, when the independent operation permission flag for at least one of the recording modules 50a-50d is 0) (S89: NO), this flow returns to S81. When the independent operation permission flag for each of all the recording modules 50a-50d is 1 (S89: YES), the controller 100 at S90 controls the upstream conveying motor 26M to drive the upstream rollers until the leading edge of the sheet P reaches a downstream side of the branch position Ak on the corresponding path.

After S90, the controller 100 at S91 sets the variable k to k−1 (k=k−1) and at S92 determines whether the variable k is equal to zero (k=0) or not. When the variable k is not equal to zero (S92: NO), this flow returns to S83. When the variable k is equal to zero (S92: YES), the controller 100 at S93 determines whether the supply permission flag for the module N is 1 or not.

When the supply permission flag for the module N is 1 (S93: YES), the controller 100 at S94 outputs the supply command for the module N. When the supply permission flag for the module N is not 1 (S93: NO), the controller 100 at S95 controls the upstream conveying motor 26M to stop the upstream rollers in a state in which the leading edge of the sheet P is located upstream of the roller pair 53a for the module N on the corresponding path. After S94 or S95, this flow returns to S81.

With the above-described control, the position of each of the pivot members 28a1-28c1 provided at the respective branch positions A1-A3 is switched depending upon conveyance of the sheets P, and each of the sheets P is successively supplied to the corresponding one of the recording modules 50a-50d.

Figure 12:
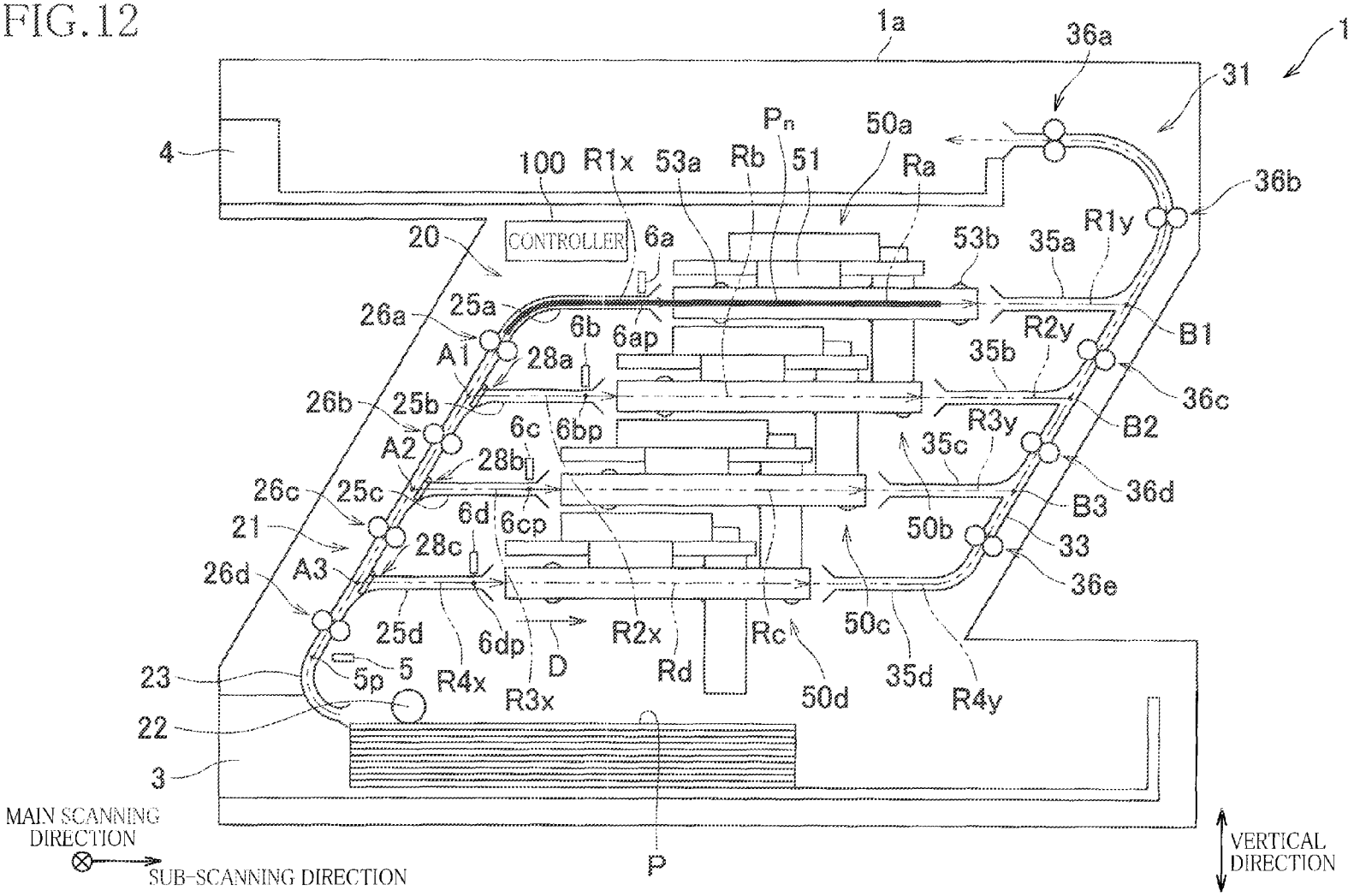
FIG. 12 is a schematic side view, corresponding to FIG. 1, illustrating a first stage of a situation in which two sheets of the A4 size or the letter size are successively supplied to first and second recording modules in order from the top.
Figure 13:
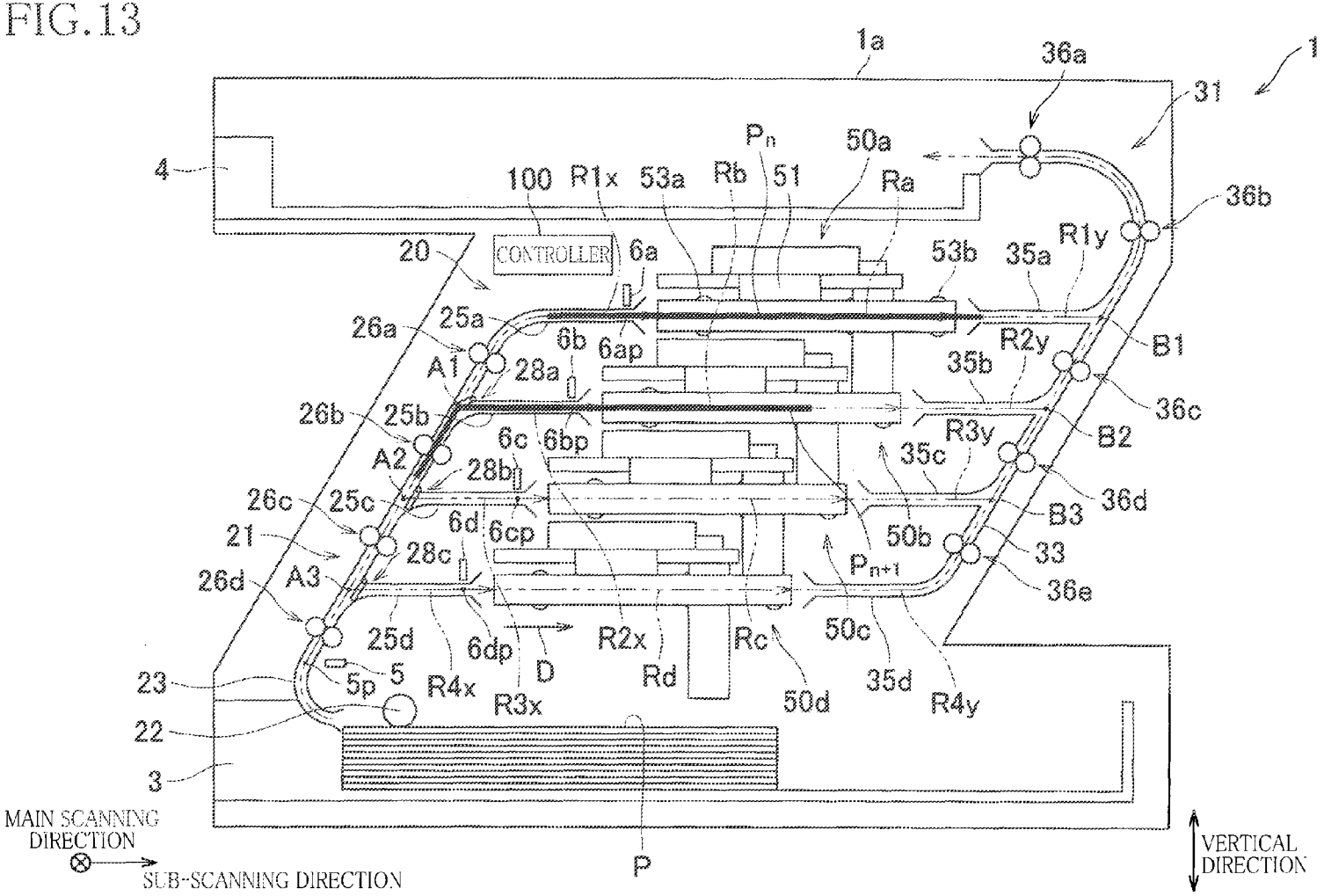
FIG. 13 is a schematic side view, corresponding to FIG. 1, illustrating a second stage of the situation in which the two sheets of the A4 size or the letter size are successively supplied to the first and second recording modules in order from the top.

FIGS. 12 and 13 chronologically illustrate situations in which sheets $P_n$ and $P_{n+1}$ of the A4 size or the letter size are successively supplied to the recording modules 50a, 50b. When the trailing edge of the sheet $P_n$ supplied to the recording module 50a is located downstream of the roller pair 26a on the path R1*x*, the sheet $P_{n-1}$ stored in the sheet storage 3 is conveyed to the roller pair 26*b* and fed to the recording module 50*b*. Also, during recording by the recording module 50*a*, the sheet $P_{n+1}$, stored in the sheet storage 3 is supplied to the recording module 50*b* such that the leading edge of the sheet $P_{n+1}$ passes through the branch position A1. FIG. 12 illustrates a situation in which recording in the first reciprocation for the sheet $P_n$ is being performed by the recording module 50*a* (i.e., the first reciprocating operation), and in this situation the trailing edge of the sheet $P_n$ is located downstream of the branch position A1 on the path R1*x*.

Figure 14:
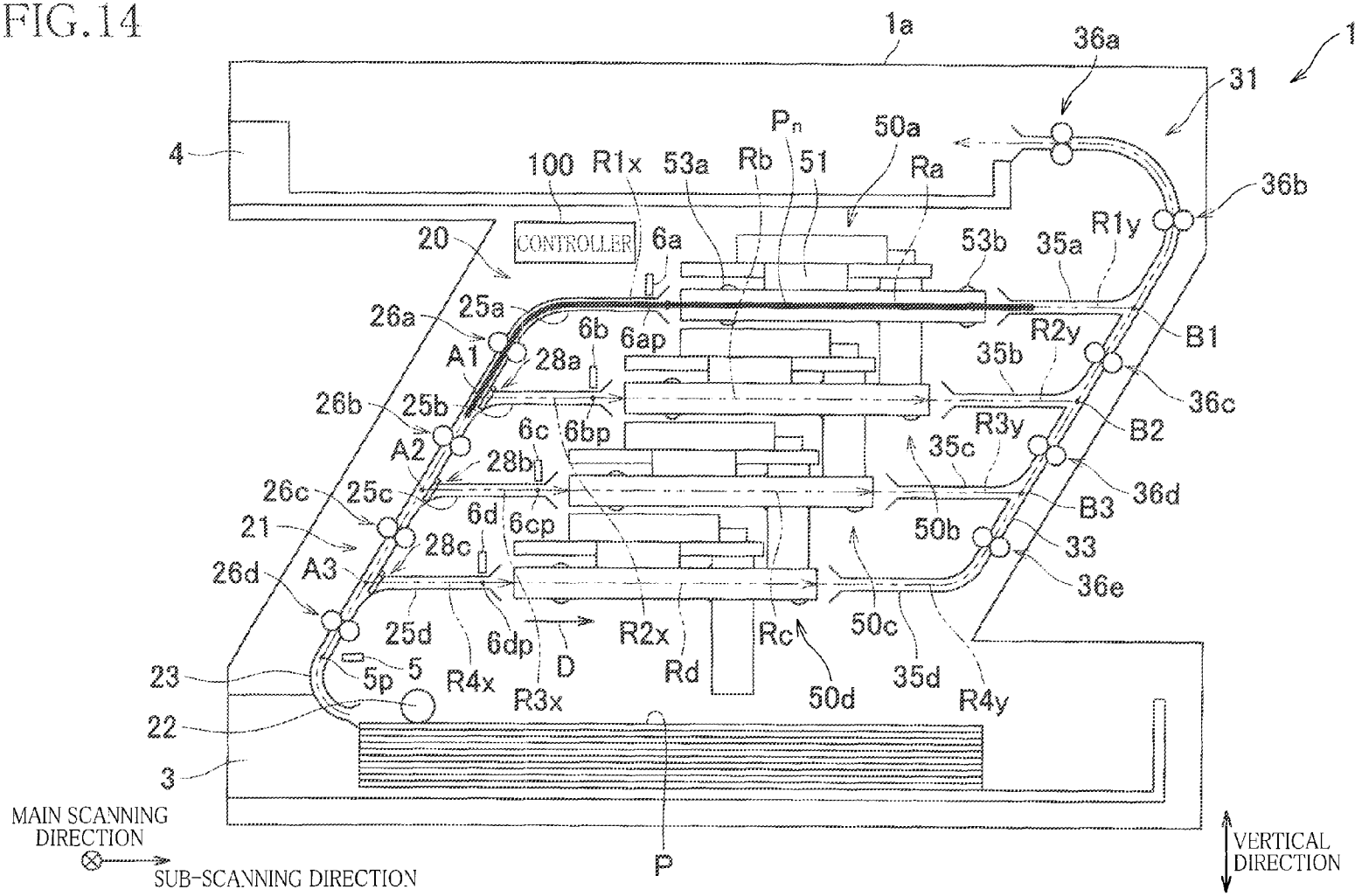
FIG. 14 is a schematic side view, corresponding to FIG. 1, illustrating a first stage of a situation in which two sheets of the A3 size are successively supplied to first and third recording modules in order from the top.
Figure 15:
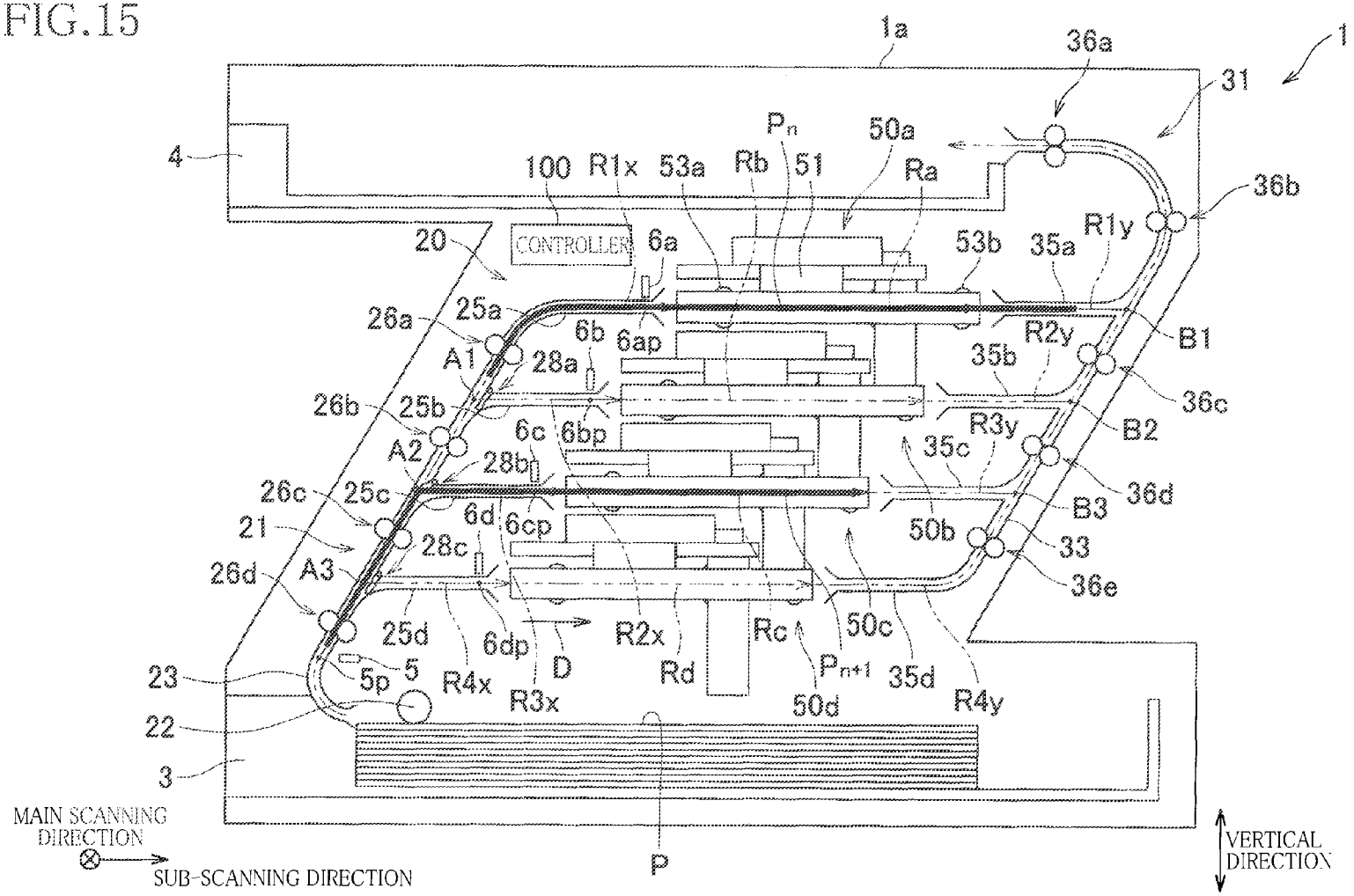
FIG. 15 is a schematic side view, corresponding to FIG. 1, illustrating a second stage of the situation in which the two sheets of the A3 size are successively supplied to the first and third recording modules in order from the top.

FIGS. 14 and 15 chronologically illustrate situations in which sheets $P_n$ and $P_{n+1}$ of the A3 size are successively supplied to the recording modules 50*a*, 50*c*. When the trailing edge of the sheet $P_n$ supplied to the recording module 50*a* is located downstream of the roller pair 26*b* and upstream of the roller pair 26*a* on the path R1*x*, the sheet $P_{n-1}$ stored in the sheet storage 3 is conveyed to the roller pair 26*b* and fed to the recording module 50*c*. FIG. 14 illustrates a situation in which a situation in which recording in the first reciprocation for the sheet $P_n$ is being performed by the recording module 50*a* (i.e., the first reciprocating operation), and in this situation the trailing edge of the sheet $P_n$ is located downstream of the branch position A2 and upstream of the branch position A1 on the path R1*x*.

In the present embodiment, the processing at S23 corresponds to a first or second determination processing, and the processings at S2 and S90 (hereinafter referred to as "processing at S2") correspond to a first or second supply processing. Specifically, the processing at S2 when the sheet P of the A4 size or the letter size is supplied to one of the recording modules 50*b*, 50*c*, 50*d* corresponds to the first supply processing (see FIGS. 12 and 13), and the processing at S2 when the sheet P of the A3 size is supplied to the recording module 50*c* corresponds to the second supply processing (see FIGS. 14 and 15). For the sheets P of the A4 size or the letter size, when the first supply processing is executed in a case where the nth sheet $P_n$ is supplied to the recording module 50*a*, the n+1th sheet $P_{n+1}$ is supplied to the recording module 50*b*, and when the first supply processing is executed in a case where the nth sheet $P_n$ is supplied to the recording module 50*b*, the n+1th sheet $P_{n+1}$ is supplied to the recording module 50*c*, and when the first supply processing is executed in a case where the nth sheet $P_n$ is supplied to the recording module 50*c*, the n+1th sheet $P_{n+1}$ is supplied to the recording module 50*d*. For the sheet P of the A3 size, when the second supply processing is executed in a case where the nth sheet $P_n$ is supplied to the recording module 50*a*, the n+1th sheet $P_{n+1}$ is supplied to the recording module 50*c*.

In the present embodiment as described above, the roller pairs 26*a*-26*d* are driven in synchronization with each other, avoiding problems which are caused in a case where the roller pairs 26*a*-26*d* are not driven in synchronization with each other (i.e., in a case where the roller pairs 26*a*-26*d* are driven independently of each other). The problems include: requirement of individual motors for the respective roller pairs 26*a*-26*d*; and a problem in which in a case where a single motor is provided for the roller pairs 26*a*-26*d*, a power-transmission switching mechanism is required, or control is complicated, leading to increased manufacturing cost. Also, in the configuration in which the roller pairs 26*a*-26*d* are driven in synchronization with each other, when the control 100 executes the first supply processing at S2 without executing the first determination processing at S23, a sheet jam may occur between the roller pairs 26*a*-26*d* driven continuously and the individual conveyors 53 driven intermittently. A throughput may lower in a case where, to prevent such a jam, the sheet P to be supplied to the second recording module (e.g., the recording module 50*b*) is intermittently conveyed by the second roller pair (e.g., the roller pair 26*b*) in accordance with the intermittent conveyance in the first recording module (e.g., the recording module 50*a*). In the present embodiment, however, since the first supply processing at S2 is executed based on the first determination processing at S23, it is possible to supply the sheets P successively by the second roller pair (e.g., the roller pair 26*b*) to the second recording module (e.g., the recording module 50*b*) while preventing the sheet jam, improving the throughput.

Specifically, one example of the first supply processing at S2 executed based on the first determination processing at S23 is the following. In the case where the sheet P is of the A4 size or the letter size, for example, the first sheet P is supplied to the first recording module (e.g., the recording module 50*a*), and the second sheet P to the second recording module (e.g., the recording module 50*b*). Here, when the controller 100 has determined that the trailing edge of the first sheet P supplied to the recording module 50*a* is located downstream of the roller pair 26*a* on the path R1*x* (S23: YES), the controller 100 sets the independent operation permission flag for the recording module 50*a* to 1 at S26 in the recording module control routine to be executed thereafter. In the upstream roller control routine, the controller 100 at S89 determines whether the independent operation permission flag for each of all the recording modules 50*a*-50*d* is 1 or not. After the controller 100 has determined that the independent operation permission flag for each of all the recording modules 50*a*-50*d* is 1 (S89: YES), the controller 100 at S94 outputs the supply command for the second sheet $P_n$ Based on this supply command, the second sheet P is at S2 supplied to the recording module 50*b*. That is, after the first determination processing at S23 for the first sheet P, the controller 100 sets the independent operation permission flag for the module N to 1 and based on this flag executes the supply processing for the second sheet P.

In the first supply processing at S2, the sheet P stored in the sheet storage 3 can be supplied to the second recording module (e.g., the recording module 50*b*) such that the leading edge of the sheet P passes through the first branch position (e.g., the branch position A1) during recording by the first recording module (e.g., the recording module 50*a*) (see FIGS. 11-13), resulting in improved throughput.

As illustrated in FIG. 1, the first path and the module path of the first recording module (e.g., the path R1*x* and the module path Ra) are defined such that a first distance L1 along the corresponding path between the first roller pair (e.g., the roller pair 26*a*) and a position Q opposite the most downstream one of the plurality of ejection openings 51*b* (see FIG. 3) of the first recording module (e.g., the recording module 50*a*) is shorter than the length of the sheet P of the A3 size. With this configuration, the first path can be made shorter, allowing downsizing of the printer 1. Also in a case where a long sheet P is used such as the sheet of the A3 size, the first supply processing at S2 is executed based on the first determination processing at S23, the throughput can be improved while preventing the sheet jam.

The first path and the module path of the first recording module (e.g., the path R1*x* and the module path Ra) are defined such that the first distance L1 is longer than or equal to a length obtained by subtracting the length of a margin formed on a leading edge portion of the sheet P in the direction D from the length of the sheet P of the A4 size or the letter size. With this configuration, even in a case where the sheet P of any of the A3 size, the A4 size, and the letter size is used, the first supply processing at S2 is executed based on the first determination processing at S23, whereby the throughput can be improved while preventing the sheet jam. Also, it is possible to reduce a waiting time and improve the throughput for the sheets P of widely used sizes such as the A4 size and the letter size in particular.

The controller 100 executes the first determination processing at S23 based on the signal output from the first sensor 5 without using the signals output from the second sensors 6*a*-6*d*. With this configuration, the controller 100 only needs to execute the processing based on the signal output from the first sensor 5, simplifying the control. Also, the second sensors 6*a*-6*d* are not necessary for the first determination processing at S23.

When the controller 100 has determined, in the second determination processing, that the trailing edge of the sheet P on which recording is being performed by the first recording module (e.g., the recording module 50*a*) is located downstream of the second roller pair (e.g., the roller pair 26*b*) on the first path (e.g., the path R1*x*) (S23: YES), the controller 100 executes the first supply processing (see FIGS. 12 and 13) or the second supply processing (see FIGS. 14 and 15) at S2 according to the size of the sheet P (the A4 size or the letter size, or the A3 size). With this configuration, the controller 100 executes the first supply processing or the second supply processing at S2 based on the second determination processing at S23, whereby the throughput can be improved while preventing the sheet jam.

When the controller has determined, for the sheet P of the A4 size or the letter size in the second determination processing, that the trailing edge of the sheet P on which recording is being performed by the first recording module (e.g., the recording module 50*a*) is located downstream of the second roller pair (e.g., the roller pair 26*b*) on the first path (e.g., the path R1*x*) (S23: YES) and when the controller has determined, in the first determination processing, that the trailing edge of the sheet P on which recording is being performed by the first recording module (e.g., the recording module 50*a*) is downstream of the first roller pair (e.g., the roller pair 26*a*) on the first path (e.g., the path R1*x*) (S23: YES), the controller 100 executes the first supply processing at S2. When the controller 100 has determined, for the sheet P of the A3 size in the second determination processing, that the trailing edge of the sheet P on which recording is being performed by the first recording module (e.g., the recording module 50*a*) is located downstream of the second roller pair (e.g., the roller pair 26*b*) on the first path (e.g., the path R1*x*) (S23: YES) and when the controller 100 has determined, in the first determination processing, that the trailing edge of the sheet P on which recording is being performed by the first recording module (e.g., the recording module 50*a*) is not located downstream of the first roller pair (e.g., the roller pair 26*a*) on the first path (e.g., the path R1*x*) (S23: NO), the controller 100 executes the second supply processing at S2. With this configuration, an area not occupied by the sheet P in each shared portion can be made relatively larger, improving the throughput.

The controller 100 executes the control such that the sheet P is conveyed to the first path (e.g., the path R1*x*) with a higher priority than the third path (e.g., the path R3*x*). With this configuration, the area not occupied by the sheet P in each shared portion can be made relatively larger, improving the throughput.

The controller 100 executes the control such that the sheet P is conveyed to the second path (e.g., the path R2*x*) with a higher priority than the third path (e.g., the path R3*x*). That is, in a case where the number of recording modules is greater than or equal to three, the controller 100 executes control such that the sheet P is to be conveyed, with a higher priority, to a path having many branch positions. With this configuration, the area not occupied by the sheet P in each shared portion can be made relatively larger, improving the throughput.

As illustrated in FIG. 1, the first path and the module path of the first recording module (e.g., the path R1*x* and the module path Ra) are defined such that a second distance L2 along the corresponding path between the first branch position (e.g., the branch position A1) and a position Q opposite the most downstream one of the plurality of ejection openings 51*b* (see FIG. 3) of the first recording module (e.g., the recording module 50*a*) is longer than a third distance L3, along the second path and the module path of the second recording module (e.g., the path R2*x* and the module path Rb), between the first branch position (e.g., the branch position A1) and a position Q opposite the most downstream one of the plurality of ejection openings 51*b* of the second recording module (e.g., the recording module 50*b*). The controller 100 executes control such that the sheet P is conveyed to the first path (e.g., the path R1*x*) with a higher priority than the second path (e.g., the path R2*x*). That is, in a case where there are two or more paths having the same number of branch positions, the controller 100 executes control such that the sheet P is conveyed with a higher priority to a path having a large length between the branch position and the position Q opposite the most downstream one of the ejection openings 51*b*. With this configuration, the area not occupied by the sheet P in the first shared portion can be made relatively larger, improving the throughput.

Figure 16:
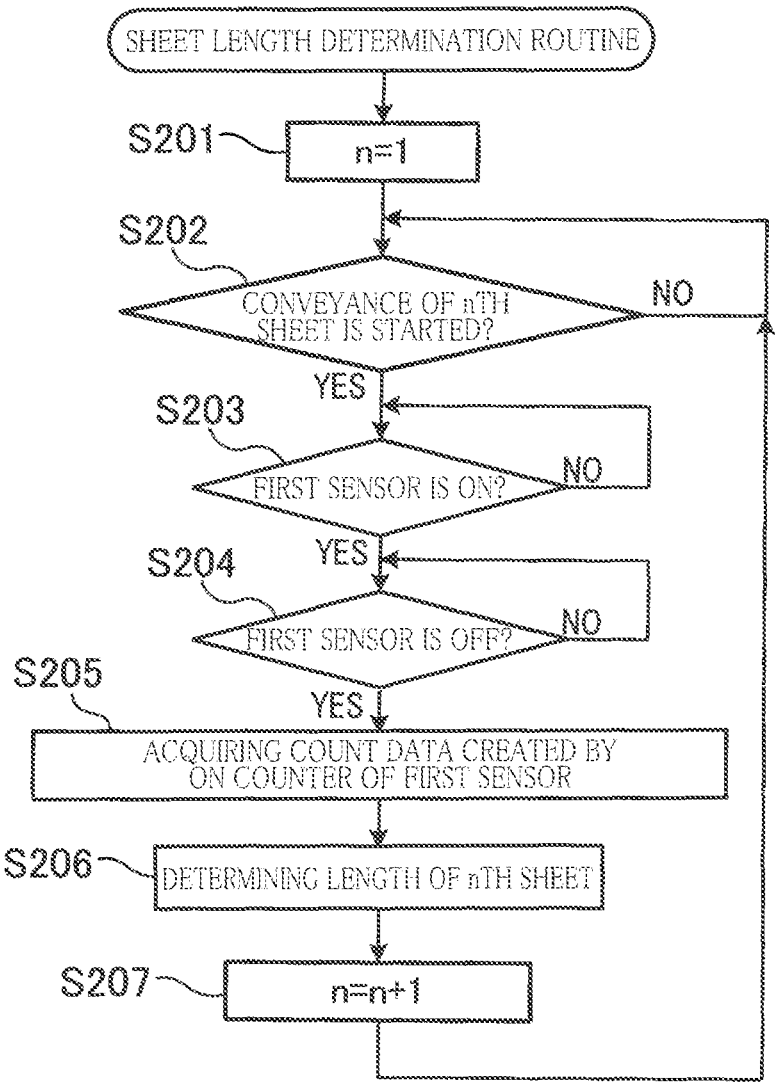
FIG. 16 is a flow chart illustrating a sheet length determination routine to be executed by a controller in an ink-jet printer according to a second embodiment of the present invention.

There will be next explained an ink-jet printer according to a second embodiment of the present invention with reference to FIG. 16.

The printer according to the second embodiment has the same construction as the printer 1 according to the first embodiment except for the processings executed by the controller 100. It is noted that the same reference numerals as used in the first embodiment are used to designate the corresponding elements of the second embodiment, and an explanation of which is dispensed with.

After determining the destination of supply of the sheet P, the controller 100 executes a sheet length determination routine (see FIG. 16) in parallel with the recording module control routine and other routines.

In the sheet length determination routine, the flow begins with S201 at which the controller 100 sets a variable n to one (n=1). After S201, the controller 100 at S202 determines whether conveyance of the nth sheet P is started or not based on a state of driving of the sheet-supply motor 22M. When the conveyance of the nth sheet P is not started (S202: NO), the controller 100 repeats the processing at S202.

When the conveyance of the nth sheet P is started (S202: YES), the controller 100 at S203 determines whether the ON signal has been output from the first sensor 5 or not. That is, the controller determines whether the leading edge of the nth sheet P has reached the first sensing position 5*p* or not. When the ON signal is not output from the first sensor 5 (S203: NO), the controller 100 repeats the processing at S203.

When the ON signal is output from the first sensor 5 (S203: YES), the controller 100 at S204 determines whether the OFF signal has been output from the first sensor 5 or not. That is, the controller determines whether the trailing edge of the nth sheet P has reached the first sensing position 5*p* or not. When the OFF signal is not output from the first sensor 5 (S204: NO), the controller 100 repeats the processing at S204.

When the OFF signal is output from the first sensor 5 (S204: YES), the controller 100 at S205 acquires the count data created by the ON counter of the first sensor 5. The controller 100 at S206 calculates and determines the length of the nth sheet P based on the acquired count data (a calculation processing). The controller 100 at S207 sets the variable n to n+1 (n=n+1), and this flow returns to S202.

In the present embodiment, the controller 100 executes the determination processings at S3, S13, S18, S23, and S29 based on the signals output from the first sensor 5 and the second sensors 6*a*-6*d*. Specifically, the following processings are executed.

The controller 100 at S3 determines that the leading edge of the sheet P has reached the roller pair 53*a* of the module N (S3: YES), when the amount of conveyance of the sheet P from the point in time when the leading edge of the sheet P has reached the first sensing position 5*p* has reached the distance Lx and when the amount of conveyance of the sheet P from the point in time when the leading edge of the sheet P has reached the corresponding one of the second sensing positions 6*ap*-6*dp* has reached a distance or amount Lx2 along the corresponding path between the corresponding one of the second sensing positions 6*ap*-6*dp* and the roller pair 53*a*.

The amount of conveyance of the sheet P from the point in time when the leading edge of the sheet P has reached the corresponding one of the second sensing positions 6*ap*-6*dp* is calculated based on the count data created by the ON counter of the corresponding one of the second sensors 6*a*-6*d*. In FIG. 1, the distance Lx2 represents a distance along the path R1*x* between the second sensing position 6*ap* to the roller pair 53*a* for the recording module 50*a*.

The controller 100 at S13 determines that the trailing edge of the sheet P is located downstream of the branch position Ak on the corresponding path (S13: YES), when the sum of (i) the amount of conveyance of the sheet P from the point in time when the leading edge of the sheet P has reached the corresponding one of the second sensing positions 6*ap*-6*dp* and (ii) a distance or amount Ly2 along the corresponding path between the branch position Ak and the corresponding one of the second sensing positions 6*ap*-6*dp* is greater than the length of sheet calculated at S206. This applies to the processing at S18. In FIG. 1, the distance Ly2 represents a distance along the path R1*x* between the branch position A1 and the second sensing position 6*ap*.

The controller 100 at S23 determines that the trailing edge of the sheet P is located downstream of the roller pair k on the corresponding path (S23: YES), when the sum of (i) the amount of conveyance of the sheet P from the point in time when the leading edge of the sheet P has reached the corresponding one of the second sensing positions 6*ap*-6*dp* and a distance or amount Lz2 along the corresponding path between the roller pair k and the corresponding one of the second sensing positions 6*ap*-6*dp* is greater than the length of sheet calculated at S206. In FIG. 1, the distance Lz2 represents a distance along the path R1*x* between the roller pair 26*a* and the second sensing position 6*ap*.

The controller 100 at S29 determines that the trailing edge of the sheet P is located downstream of the roller pair 53*a* on the corresponding path (S29: YES), when the amount of conveyance of the sheet P from the point in time when the leading edge of the sheet P has reached the corresponding one of the second sensing positions 6*ap*-6*dp* is greater than the sum of the length of sheet calculated at S206 and the distance Lx2.

In the present embodiment as described above, the controller 100 executes the first determination processing at S23 based on the signals output from the first sensor 5 and the second sensors 6*a*-6*d*. If the controller executes the first determination processing at S23 only based on the signal output from the first sensor 5, a mistake may be made in the determination in a case where the sheet P is not being appropriately conveyed due to skid or other causes. In the present embodiment as described above, however, the controller 100 executes the first determination processing at S23 based on the signals output from the first sensor 5 and the second sensors 6*a*-6*d*, thereby reducing the possibility of mistake in the determination, resulting in improvement in reliability of the determination in the first determination processing at S23. Since the skid easily occurs on a short sheet P in particular, the above-described configuration is particularly effective for the short sheet P.

Figure 17:
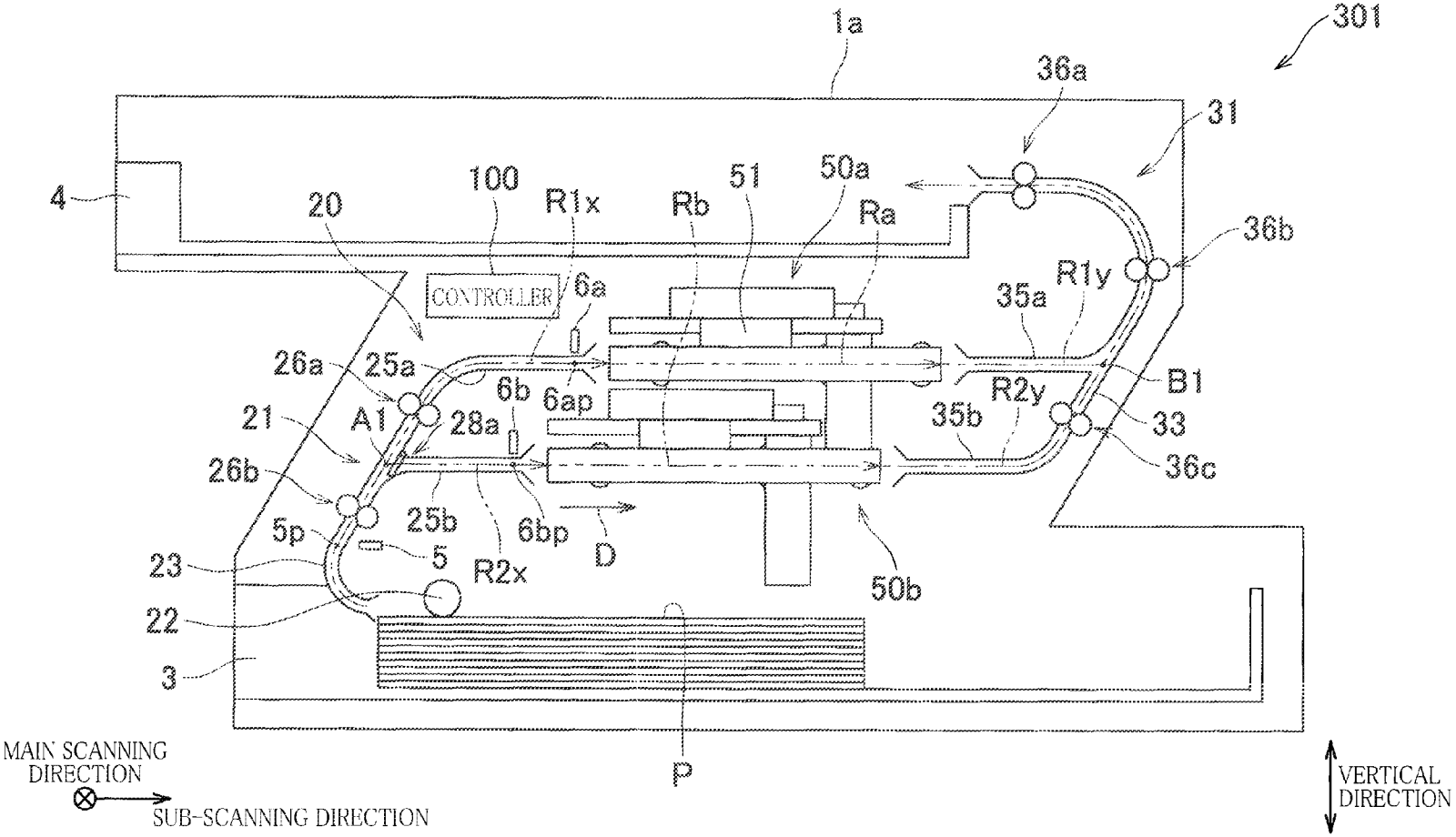
FIG. 17 is a schematic side view, corresponding to FIG. 1, illustrating an internal structure of an ink-jet printer according to a third embodiment of the present invention.

There will be next explained an ink-jet printer 301 according to a third embodiment of the present invention with reference to FIG. 17.

The printer 301 according to the third embodiment has the same construction as the printer 1 according to the first embodiment except for the number of recording modules and a construction of paths. It is noted that the same reference numerals as used in the first embodiment are used to designate the corresponding elements of the third embodiment, and an explanation of which is dispensed with.

The printer 301 includes two recording modules 50*a*, 50*b*. Two cartridges, not shown, are mountable on and removable from the housing 1*a*. The upstream unit 21 has two paths R1*x*, R2*x* through which the sheet P is conveyed from the sheet storage 3 to the respective module paths Ra, Rb formed in the respective recording modules 50*a*, 50*b*. The downstream unit 31 has two paths R1*y*, R2*y* through which the sheet P is conveyed from the downstream end portions of the respective module paths Ra, Rb to the sheet receiver 4.

Also in the third embodiment, the same construction as employed in the first embodiment can achieve the same effects as obtained in the first embodiment.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

The number of recording modules may be any number as long as a plurality of recording modules are provided. The recording modules are used in order from above in the above-described embodiment, but the present invention is not limited to this configuration. For example, the recording modules may be used in order from below and may be used in other orders.

The positional relationship between the recording modules is not limited in particular. For example, while the four recording modules 50*a*-50*d* are arranged at different positions in the sub-scanning direction in the above-described embodiment, the recording modules may be arranged without difference in positions in the sub-scanning direction, that is, the recording modules may be arranged at the same position in the sub-scanning direction. Two recording modules adjacent to each other in the vertical direction may be arranged at different positions in a direction, in the plane of the module paths, which differs from the sub-scanning direction (e.g., the main scanning direction). The plurality of recording modules may not be arranged in the vertical direction, and the plurality of recording modules may be arranged in the horizontal direction and may not be arranged in one direction.

Recording modules assumed to be the first recording module, the second recording module, and the third recording module among the plurality of recording modules may be changed as needed according to, e.g., the construction of the paths.

Another recording module may be disposed between the first recording module and the second recording module.

Likewise, another recording module may be disposed between the second recording module and the third recording module.

The plurality of recording modules may have different constructions. For example, the plurality of recording modules may be different from each other in, e.g., recordable color, resolution, recording speed, recording method, type of recordable recording medium, and size of recordable recording medium.

The plurality of roller pairs constituting the individual conveyor may be driven by the same drive source and may be driven respectively by individual drive sources. In the above-described embodiment, the roller pair 53*b* may not be the one-way roller, and the roller pairs 53*a*, 53*b* may be driven in complete synchronization with each other.

The intersecting angle of a plurality of paths and the angle of a curved portion of one path may be any angles. For example, the guide 23 and each of the guides 25*a*-25*d* are not perpendicular to each other in the above-described embodiment but may be perpendicular to each other. Likewise, the guide 33 and each of the guides 35*a*-35*d* are not perpendicular to each other in the above-described embodiment but may be perpendicular to each other.

Relationship of position, angle, and so on between the plurality of paths may be any relationship. In the above-described embodiment, for example, the angles of the guide 23, 33 with respect to the vertical direction may or may not be the same as each other. The plurality of paths may not include a complete shared portion which is shared by all the paths. The number of paths and the construction of each path may be changed according to the number and/or arrangement of recording modules. Limitation on the length of the path (e.g., a first length and a second length) is not essential in the present invention.

The plurality of pivot members constituting the switcher may be driven by the same drive source and may be driven respectively by individual drive sources. The switcher may not include the pivot members used in the above-described embodiment. For example, the switcher may be configured to switch the path by applying an external force to the recording medium by, e.g., an electrostatic force or air without contacting the recording medium.

Roller pairs assumed to be the first roller pair, the second roller pair, and the third roller pair may be changed as needed according to, e.g., the construction of the paths.

Each of the first sensor and the second sensor may be any type of sensor such as an optical sensor, a mechanical sensor, and a magnetic sensor. The first sensing position may be any position as long as the first sensing position is located at the first shared portion. For example, the first sensing position may be located downstream of the second branch position and may overlap the second roller pair. The second sensing position may be defined in the module path of the first recording module. A plurality of the first sensors may be provided. The second sensor may be omitted.

A calculating method in each determination may be changed as needed. For example, in a case where the first sensing position 5*p* is located at the second roller pair, a distance between the first sensing position 5*p* and the second roller pair is zero. In this case, accordingly, the controller may determine, without calculating the conveyance amount, that the trailing edge of the sheet P is located downstream of the second roller pair (S23: YES), at a point in time when the trailing edge of the sheet P has reached the first sensing position 5*p*.

When the controller has determined that the trailing edge of the recording medium is located downstream of the roller pair in each determination processing, the controller may not always execute the supply processing.

The controller may execute the first determination processing with reference to a predetermined position located downstream of the first roller pair on the first path. That is, the controller may determine, in the first determination processing, that the trailing edge of the recording medium is located downstream of the first roller pair on the first path, when the trailing edge of the recording medium has reached the above-described predetermined position.

The controller may execute the second determination processing with reference to a predetermined position located downstream of the second roller pair on the first path. That is, the controller may determine, in the second determination processing, that the trailing edge of the recording medium is located downstream of the second roller pair on the first path, when the trailing edge of the recording medium has reached the above-described predetermined position. The controller may not execute the second determination processing or the second supply processing.

A higher priority may be given to any of the plurality of paths for conveyance of the recording medium. The controller may determine, at any timing, combination of the recording media and paths to which the recording media are to be conveyed. The timing is not limited to a point in time between the reception of the recording command and the start of the conveyance of the recording medium and may be a point in time after the recording operation is started (e.g., a point in time after a start of conveyance of the preceding recording medium or a point in time between the start of conveyance of the recording medium and a start of operation of the switcher). Recording may be performed on a first surface of the recording medium and a second surface of the recording medium which is a back side from the first surface (e.g., a front surface and a back surface of the sheet P).

The size of the first recording medium is not limited to the A3 size and may be any size such as the postcard size, the A6 size, the A4 size, the letter size, or the like. The size of the second recording medium is not limited to the A4 size or the letter size and may be the postcard size, the A6 size, or the like. The recording medium is not limited to the sheet and may be any recording medium.

Each of the sheet storage and the sheet receiver may be disposed any position. For example, the sheet receiver may be disposed at a position at which only a part of the plurality of recording modules is interposed between the sheet receiver and the sheet storage in a direction of the arrangement of the recording modules. The sheet storage and the sheet receiver may be disposed on the same side of the plurality of recording modules. The sheet storage and/or the sheet receiver may be disposed at a position not overlapping any of the recording modules in the direction of the arrangement of the recording modules. A recording-medium support surface of the sheet storage and/or the sheet receiver may be inclined with respect to the horizontal direction.

The present invention is applicable not only to the serial printer but also to a line printer. The present invention is applicable not only to the printer but also to other devices such as a facsimile machine and a copying machine.

What is claimed is:

1. A recording apparatus, comprising:

a plurality of recording modules each comprising: a head formed with a plurality of ejection openings for ejecting liquid; a carriage supporting the head and configured to move the head in a first direction; a module path; and an individual conveyor configured to convey a recording medium along the module path in a second direction perpendicular to the first direction, the plurality of recording modules comprising a first recording module and a second recording module different from the first recording module;

a storage configured to accommodate the recording medium;

a first path through which the recording medium is to be conveyed from the storage to the module path of the first recording module;

a second path through which the recording medium is to be conveyed from the storage to the module path of the second recording module, the second path comprising, at an upstream portion thereof, a first shared portion shared with the first path, the second path being branched off from the first path at a first branch position located at an end portion of the first shared portion;

a first switcher configured to switch, at the first branch position, a destination of the recording medium between the first path and the second path;

a first roller pair disposed downstream of the first branch position on the first path and comprising two rollers contacting each other, the first roller pair being configured to convey the recording medium in a state in which the recording medium is nipped by the two rollers of the first roller pair;

a second roller pair disposed on the first shared portion and comprising two rollers contacting each other, the second roller pair being configured to convey the recording medium in a state in which the recording medium is nipped by the two rollers of the second roller pair, a driving device configured to drive the first roller pair and the second roller pair in synchronization with each other;

a first sensor configured to output a signal indicating presence or absence of the recording medium at a first sensing position located on the first shared portion; and a controller configured to control the plurality of recording modules, the first switcher, and the driving device, the controller being configured to execute:

a first determination processing in which based on the signal output from the first sensor the controller determines whether a trailing edge of the recording medium on which recording is being performed by the first recording module is located downstream of the first roller pair on the first path; and a first supply processing in which when the controller has determined in the first determination processing that the trailing edge of the recording medium is located downstream of the first roller pair on the first path, the controller controls the first switcher and the driving device to cause the second roller pair to supply a recording medium from the storage to the second recording module.

2. The recording apparatus according to claim 1, wherein the controller is configured to, in the first supply processing, control the driving device to supply the recording medium from the storage to the second recording module such that the recording medium passes through the first branch position during recording performed by the first recording module.

3. The recording apparatus according to claim 1, wherein the first path and the module path of the first recording module are defined such that a first distance along the first path and the module path of the first recording module between the first roller pair and a position opposite a most downstream one of the plurality of ejection openings of the first recording module is less than a length of a first recording medium in the second direction, and the first recording medium is greatest in length among a plurality of sizes of recording media accommodatable in the storage.

4. The recording apparatus according to claim 3, wherein the first path and the module path of the first recording module are defined such that the first distance is greater than or equal to a length obtained by subtracting a length of a margin formed on a leading edge portion of a second recording medium in the second direction, from a length of the second recording medium in the second direction, and the second recording medium is one of the plurality of sizes of recording media accommodatable in the storage and less in length than the first recording medium in the second direction.

5. The recording apparatus according to claim 4, wherein the second recording medium is of an A4 size.

6. The recording apparatus according to claim 4, wherein the second recording medium is of a letter size.

7. The recording apparatus according to claim 1, further comprising a second sensor configured to output a signal indicating presence or absence of the recording medium at a second sensing position located on one of the module path of the first recording module and a portion of the first path which is located downstream of the first branch position, wherein the controller is configured to execute the first determination processing based on the signal output from the first sensor and the signal output from the second sensor.

8. The recording apparatus according to claim 1, wherein the plurality of recording modules further comprise a third recording module different from the first recording module and the second recording module, wherein the recording apparatus further comprises:

a third path through which the recording medium is to be conveyed from the storage to the module path of the third recording module, the third path comprising, at an upstream portion thereof, a second shared portion shared with the first shared portion, the third path being branched off from the first shared portion at a second branch position located at an end portion of the second shared portion;

a second switcher configured to switch, at the second branch position, a destination of the recording medium between the third path and one of the first path and the second path; and a third roller pair disposed upstream of the second branch position on the second shared portion and comprising two rollers contacting each other, the third roller pair being configured to convey the recording medium in a state in which the recording medium is nipped by the two rollers of the third roller pair, wherein the second roller pair is disposed on the second path at a position located downstream of the second branch position and upstream of the first branch position, wherein the driving device is configured to drive the first roller pair, the second roller pair, and the third roller pair in synchronization with each other, wherein the controller is configured to execute:

a second determination processing in which based on the signal output from the first sensor the controller determines whether the trailing edge of the recording medium on which recording is being performed by the first recording module is located downstream of the second roller pair on the first path; and one of the first supply processing and a second supply processing in which the controller controls the second switcher and the driving device to cause the third roller pair to supply the recording medium from the storage to the third recording module, when the controller has determined in the second determination processing that the trailing edge of the recording medium is located downstream of the second roller pair on the first path.

9. The recording apparatus according to claim 8, wherein the controller is configured to execute the first supply processing when the controller has determined in the second determination processing that the trailing edge of the recording medium is located downstream of the second roller pair on the first path and when the controller has determined in the first determination processing that the trailing edge of the recording medium is located downstream of the first roller pair on the first path, and wherein the controller is configured to execute the second supply processing when the controller has determined in the second determination processing that the trailing edge of the recording medium is located downstream of the second roller pair on the first path and when the controller has determined in the first determination processing that the trailing edge of the recording medium is not located downstream of the first roller pair on the first path.

10. The recording apparatus according to claim 8, wherein the controller is configured to execute control such that the recording medium is conveyed to the first path with higher priority than the third path.

11. The recording apparatus according to claim 8, wherein the controller is configured to execute control such that the recording medium is conveyed to the second path with higher priority than the third path.

12. The recording apparatus according to claim 1, wherein the first path and the module path of the first recording module are defined such that a second distance along the first path and the module path of the first recording module between the first branch position and a position opposite a most downstream one of the plurality of ejection openings of the first recording module is greater than a third distance along the second path and the module path of the second recording module between the first branch position and a position opposite a most downstream one of the plurality of ejection openings of the second recording module, and wherein the controller is configured to execute control such that the recording medium is conveyed to the first path with higher priority than the second path.

* * * * *